US011687022B2

(12) United States Patent
Nakamura et al.

(10) Patent No.: US 11,687,022 B2
(45) **Date of Patent: *Jun. 27, 2023**

(54) SHEET STACKER AND IMAGE FORMING APPARATUS INCORPORATING THE SHEET STACKER

(71) Applicants: Kazune Nakamura, Tokyo (JP); Yosuke Eguchi, Tokyo (JP)

(72) Inventors: Kazune Nakamura, Tokyo (JP); Yosuke Eguchi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 527 days.

This patent is subject to a terminal disclaimer.

(21) Appl. No.: 16/859,079

(22) Filed: Apr. 27, 2020

(65) Prior Publication Data

US 2020/0371465 A1 Nov. 26, 2020

(30) Foreign Application Priority Data

May 21, 2019 (JP) ..... 2019-095082
Feb. 5, 2020 (JP) ..... 2020-017661
Mar. 18, 2020 (JP) ..... 2020-048375

(51) Int. Cl.
*G03G 15/00* (2006.01)
*B65H 31/02* (2006.01)
(Continued)

(52) U.S. Cl.
CPC ..... *G03G 15/6538* (2013.01); *B65H 31/02* (2013.01); *B65H 31/10* (2013.01);
(Continued)

(58) Field of Classification Search
CPC ..... B65H 31/02; B65H 31/10; B65H 2405/1124; B65H 2511/214;
(Continued)

(56) References Cited

U.S. PATENT DOCUMENTS 8,678,368 B2 * 3/2014 Yoshida ..... B65H 31/02 270/58.11
11,339,022 B2 * 5/2022 Yamaji ..... B65H 31/10
(Continued)

FOREIGN PATENT DOCUMENTS

JP 2014-169161 9/2014

*Primary Examiner* — Jeremy R Severson
(74) *Attorney, Agent, or Firm* — Harness, Dickey & Pierce, P.L.C.

(57) ABSTRACT

A sheet stacker includes a sheet stacking member, a biasing force applier, an angle setter, and a regulator. The sheet stacking member has an upstream portion in a sheet conveyance direction. The upstream portion is movable in a vertical direction. The biasing force applier is configured to apply a biasing force to bias the sheet stacking member upward. The angle setter is configured to set an angle of the sheet stacking member in the sheet conveyance direction, relative to a sheet conveying portion, between a first angle and a second angle. The regulator is configured to regulate movement of the sheet stacking member in a case in which the upstream portion of the sheet stacking member is located closer to the sheet conveying portion at either the first angle or the second angle.

20 Claims, 28 Drawing Sheets

(51) Int. Cl.
*G03G 21/16* (2006.01)
*B65H 31/10* (2006.01)

(52) U.S. Cl.
CPC ..... *G03G 15/6552* (2013.01); *G03G 21/1647* (2013.01); *B65H 2301/421* (2013.01); *B65H 2405/1117* (2013.01); *B65H 2405/11151* (2013.01); *B65H 2801/06* (2013.01); *G03G 2215/00421* (2013.01)

(58) Field of Classification Search
CPC .... B65H 2301/421; B65H 2405/11151; G03G 15/6538; G03G 15/6552; G03G 21/1647
See application file for complete search history.

(56) References Cited

U.S. PATENT DOCUMENTS

| | | | | |
|---|---|---|---|---|
| 2012/0061903 | A1 | 3/2012 | Eguchi et al. | |
| 2013/0250328 | A1 | 9/2013 | Ohtsuka et al. | |
| 2013/0270765 | A1 | 10/2013 | Araaki et al. | |
| 2016/0332829 | A1 | 11/2016 | Eguchi | |
| 2017/0255153 | A1 | 9/2017 | Eguchi | |
| 2018/0127222 | A1 | 5/2018 | Kuno et al. | |
| 2020/0270089 | A1* | 8/2020 | Yamaji ..... | B65H 31/14 |

* cited by examiner

SHEET STACKER AND IMAGE FORMING APPARATUS INCORPORATING THE SHEET STACKER

CROSS-REFERENCE TO RELATED APPLICATIONS

This patent application is based on and claims priority pursuant to 35 U.S.C. § 119(a) to Japanese Patent Application Nos. 2019-095082, filed on May 21, 2019, 2020-017661, filed on Feb. 5, 2020, and 2020-048375, filed on Mar. 18, 2020, in the Japan Patent Office, the entire disclosure of each of which is hereby incorporated by reference herein.

BACKGROUND

Technical Field

This disclosure relates to a sheet stacker and an image forming apparatus incorporating the sheet stacker.

Background Art

Various types of sheet stackers are provided in an electrophotographic image forming apparatus to stack a sheet or sheets on a sheet stacking face of a sheet stacking member.

SUMMARY

At least one aspect of this disclosure provides a novel sheet stacker includes a sheet stacking member, a biasing member, an angle setter, and a regulator. The sheet stacking member has an upstream portion in a sheet conveyance direction, the upstream portion being movable in a vertical direction. The biasing force applier is configured to apply a biasing force to bias the sheet stacking member upward. The angle setter is configured to set an angle of the sheet stacking member in the sheet conveyance direction, relative to a sheet conveying portion, between a first angle and a second angle. The regulator is configured to regulate movement of the sheet stacking member in a case in which the upstream portion of the sheet stacking member is located closer to the sheet conveying portion at either the first angle or the second angle.

Further, at least one aspect of this disclosure provides an improved image forming apparatus includes an image bearer configured to form an image on a sheet, and the above-described sheet stacker configured to stack the sheet having the image on the image bearer.

BRIEF DESCRIPTION OF THE SEVERAL VIEWS OF THE DRAWINGS

Exemplary embodiments of this disclosure will be described in detail based on the following figures, wherein.

Figure 1:
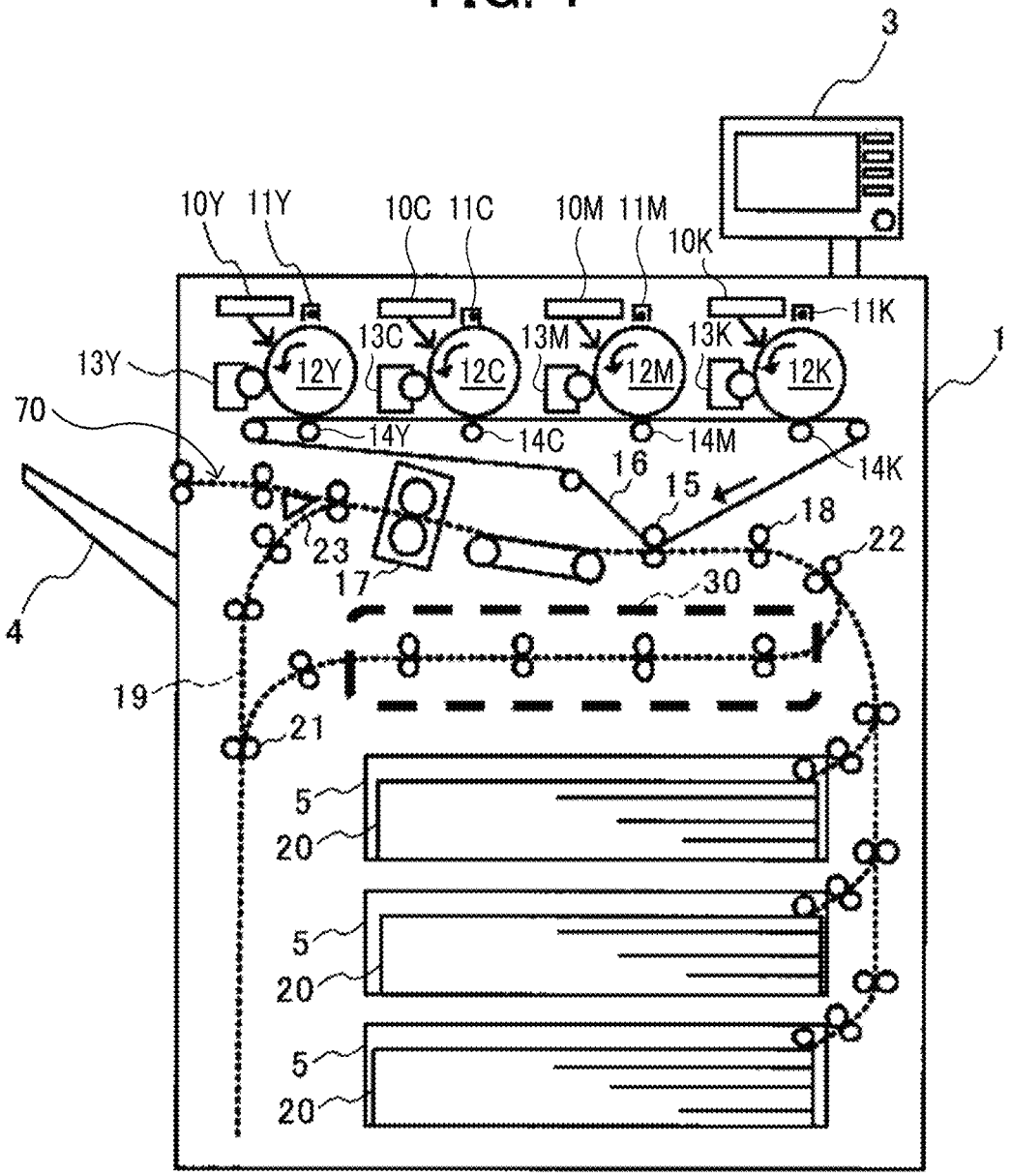
FIG. 1 is a schematic view illustrating an example of an image forming apparatus according to an embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, a detailed description is given of an embodiment of this disclosure with reference to the drawings.

FIG. 1 is a schematic view illustrating an example of an image forming apparatus 1 according to an embodiment of this disclosure.

As illustrated in FIG. 1, the image forming apparatus 1 (a printer in this disclosure) includes an intermediate transfer belt 16. The intermediate transfer belt 16 moves while being stretched over a plurality of rollers. On the upper side in FIG. 1, photoconductors 12Y, 12C, 12M, and 12K are provided for forming yellow (Y), cyan (C), magenta (M), and black (K) images, respectively. Hereinafter, the photoconductors 12Y, 12C, 12M, and 12K are occasionally referred to as a photoconductor 12 in a singular form, for convenience. The photoconductors 12 that functions as an image bearer is surrounded by a laser scanning unit 10 (that is, laser scanning units 10Y, 10C, 10M, and 10K), a charging unit 11 (that is, charging units 11Y, 11C, 11M, and 11K), a developing unit 13 (that is, developing units 13Y, 13C, 13M, and 13K), and a primary transfer roller 14 (that is, primary transfer rollers Y, 14C, 14M, and 14K). The primary transfer roller 14 is disposed facing the photoconductor 12 while sandwiching the intermediate transfer belt 16 with the photoconductor 12.

A secondary transfer roller 15 is provided in a secondary transfer portion and below the intermediate transfer belt 16. After being transferred onto the intermediate transfer belt 16 by primary transfer, a toner image is then transferred onto a sheet 20 by secondary transfer. A fixing device 17 is provided downstream from the secondary transfer portion having the secondary transfer roller 15, in a sheet conveyance direction in which the sheet 20 is conveyed. A sheet position correcting device 30 is provided substantially at the center of the housing of the image forming apparatus 1, below the secondary transfer portion and the fixing device 17, and in the middle of a sheet reversal conveyance passage 19 along which the sheet 20 is conveyed.

A control panel 3 is disposed on top of the housing of the image forming apparatus 1. A sheet ejection device 4 that functions as a sheet stacker is disposed on the left-side face of the housing of the image forming apparatus 1 in FIG. 1. Further, three sheet feed trays 5 (specifically, first, second, and third sheet feed trays 5) are disposed in a lower part of the housing of the image forming apparatus 1, below the sheet position correcting device 30. Each of the sheet feed trays 5 contains the sheet 20 or a sheet bundle including the sheet 20. Hereinafter, the sheet 20 is occasionally referred to as the "sheets 20" in a plural form. Specifically, each of the first, second, and third sheet feed trays 5 stores the sheet 20 such as a transfer sheet and a resin film. Any one of the first, second, and third sheet feed trays 5 is selected according to the sheet 20 to use for image formation, via the control panel 3 or an input terminal such as a personal computer. The image forming apparatus 1 further includes a control device that functions as a controller including various units, for example, a central processing unit (CPU), a random-access memory (RAM), and a read only memory (ROM), to control the image forming apparatus 1.

As a print job starts in the image forming apparatus 1, the photoconductor 12 (that is, the photoconductors 12Y, 12C, 12M, and 12K) is rotated in a counterclockwise direction in FIG. 1. At this time, the charging unit 11 (that is, the charging units 11Y, 11C, 11M, and 11K) uniformly charges the surface of the photoconductor 12 to a given charging polarity. Then, the laser scanning unit 10 (i.e., the laser scanning units 10Y, 10C, 10M, and 10K) emits laser light based on image data, onto the charged surface of the photoconductor 12, thereby forming an electrostatic latent image on the surface of the photoconductor 12. Then, the developing unit 13 develops the electrostatic latent image formed on the surface of the photoconductor 12 into a visible toner image. The toner image is transferred onto the surface of the intermediate transfer belt 16 by the primary transfer roller 14. Note that residual toner remains on the surface of the photoconductor 12 after the primary transfer of the toner image onto the intermediate transfer belt 16. Such residual toner is removed by a photoconductor cleaning unit provided in the housing of the image forming apparatus 1.

When forming a color image, the above-described image forming operation is performed in the photoconductors 12Y, 12C, 12M, and 12K, so that a yellow toner image, a cyan toner image, a magenta toner image, and a black toner image formed on respective photoconductors 12Y, 12C, 12M, and 12K are sequentially transferred onto the intermediate transfer belt 16 in a superimposed manner.

On the other hand, as described above, any one of the first, second, and third sheet feed trays 5 disposed in the lower part of the housing of the image forming apparatus 1 is selected according to the sheet 20 to use for image formation. After the sheet feed tray 5 is selected via the control panel 3 or the input terminal such as a personal computer, the sheet 20 is fed from the selected sheet feed tray 5. The sheet 20 fed from the selected sheet feed tray 5 is conveyed toward a pair of registration rollers 18. The sheet 20 contacts the pair of registration rollers 18 while the pair of registration rollers 18 is stopped (is not rotating). Thus, after the leading end of the sheet 20 is aligned, the pair of registration rollers 18 conveys the sheet 20 toward the secondary transfer portion, in which the secondary transfer roller 15 and the sheet 20 meets the toner image, on the intermediate transfer belt 16.

Then, the toner image formed on the surface of the intermediate transfer belt 16 is transferred onto the sheet 20 by the secondary transfer roller 15. After the toner image has been transferred onto the sheet 20, the sheet 20 is conveyed to the fixing device 17, where the unfixed toner image is fixed, and then is ejected by a pair of sheet ejection rollers 2*a*1 and 2*a*2 to the sheet ejection device 4 via a sheet conveyance passage 70. Note that residual toner remains on the surface of the intermediate transfer belt 16 12 after the secondary transfer of the toner image onto the sheet 20. Such residual toner is removed by an intermediate transfer belt cleaning unit provided in the housing of the image forming apparatus 1.

In a case in which duplex printing on the sheet 20 is selected via the control panel 3 or the input terminal such as a personal computer, a switching claw 23 switches and changes an orientation (sheet conveyance passage) of the sheet 20, so that the sheet 20 having an image on a first face is conveyed to a duplex printing passage. Then, the sheet 20 is conveyed to a sheet reversing roller 21. When the sheet 20 sent to the sheet reversing roller 21 by the switching claw 23, the sheet reversing roller 21 starts rotating in the opposite direction (reverse direction) to a regular rotational direction (forward rotation), thereby conveying the sheet 20 to the sheet position correcting device 30. At this time, the front and back faces of the sheet 20 in the sheet conveyance direction are reversed from first face image formation. After the sheet 20 is conveyed from a relay roller 22 to the pair of registration rollers 18, a second image is formed on a second face of the sheet 20 by the same process as the above-described image formation, and then the sheet 20 is ejected to the sheet ejection device 4.

Next, a description is given of the configuration and operations of the sheet ejection device 4 that functions as a sheet stacker.

Figure 2:
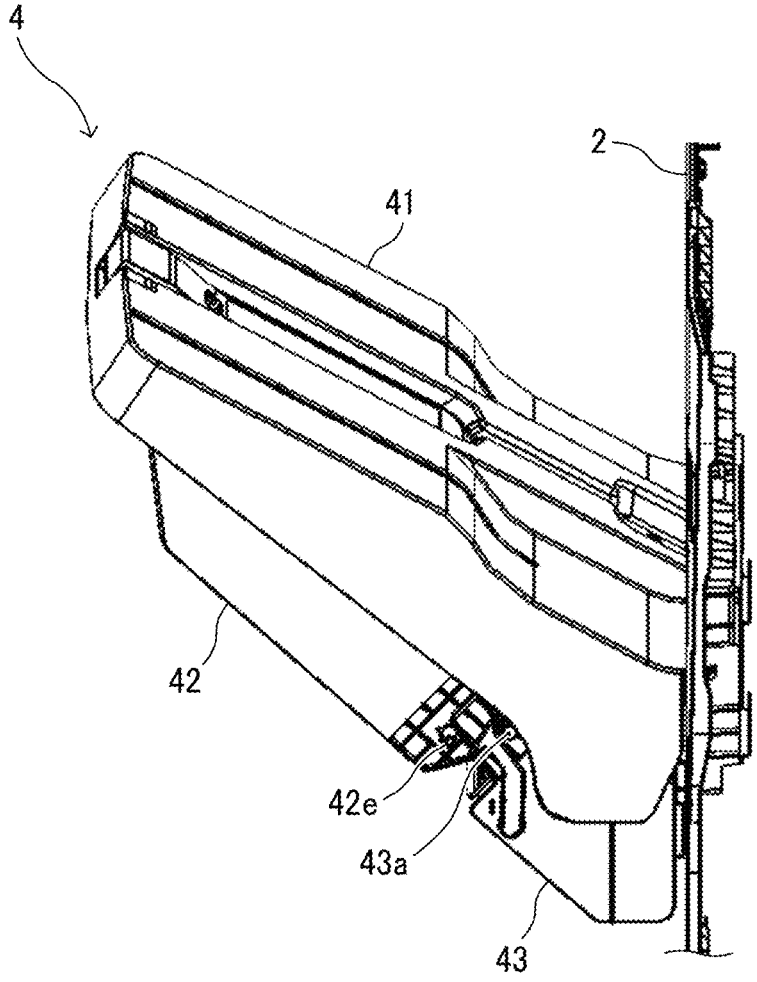
FIG. 2 is a perspective view illustrating a sheet ejection tray according to an embodiment of this disclosure, viewed from obliquely above.

FIG. 2 is a perspective view illustrating the sheet ejection device 4 according to the present embodiment of this disclosure, viewed from obliquely above.

Figure 3:
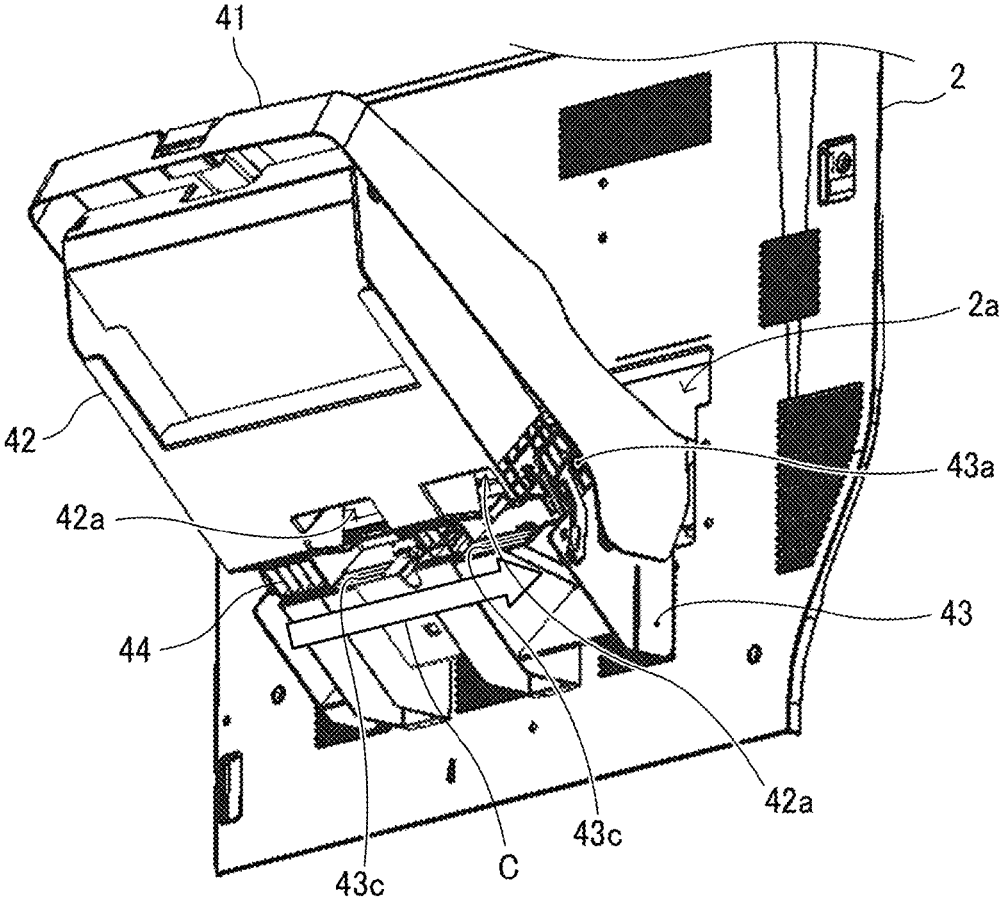
FIG. 3 is a perspective view illustrating the sheet ejection tray according to an embodiment of this disclosure, viewed from obliquely below.

FIG. 3 is a perspective view illustrating the sheet ejection device 4 according to the present embodiment of this disclosure, viewed from obliquely below.

Figure 4:
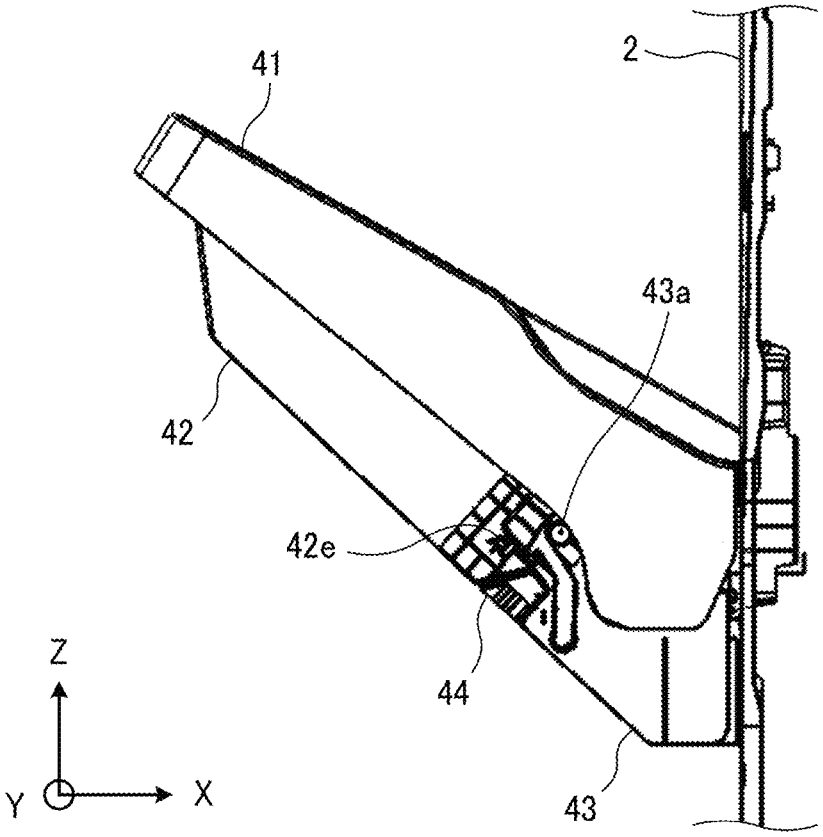
FIG. 4 is a side view illustrating the sheet ejection tray.

FIG. 4 is a side view illustrating the sheet ejection device 4 according to the present embodiment of this disclosure.

Figure 5:
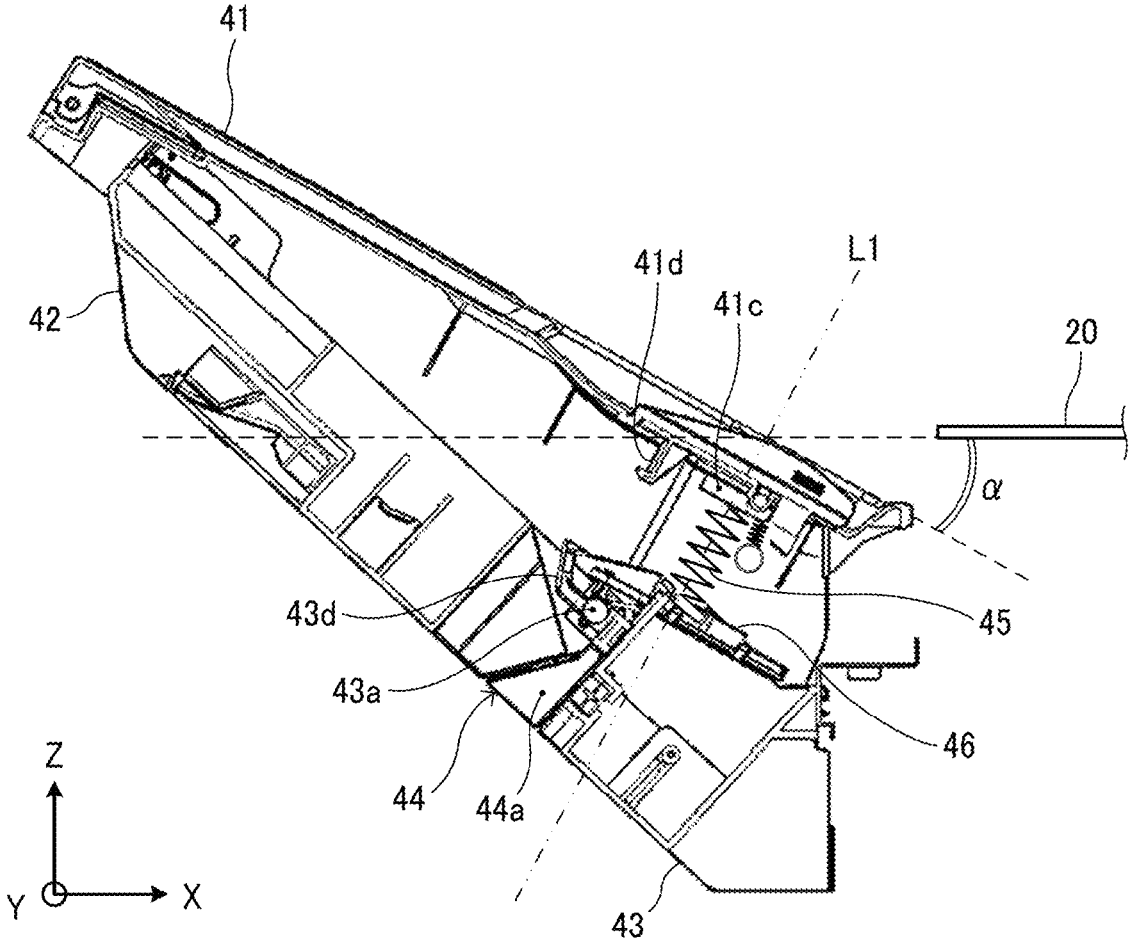
FIG. 5 is a cross-sectional view illustrating the sheet ejection tray having a first angle α as a tray angle, when the sheet ejection tray is cross-sectioned along a sheet conveyance direction.

FIG. 5 is a cross-sectional view illustrating the sheet ejection device 4 according to the present embodiment of this disclosure, when the sheet ejection device 4 is cross-sectioned along the sheet conveyance direction.

Figure 6:
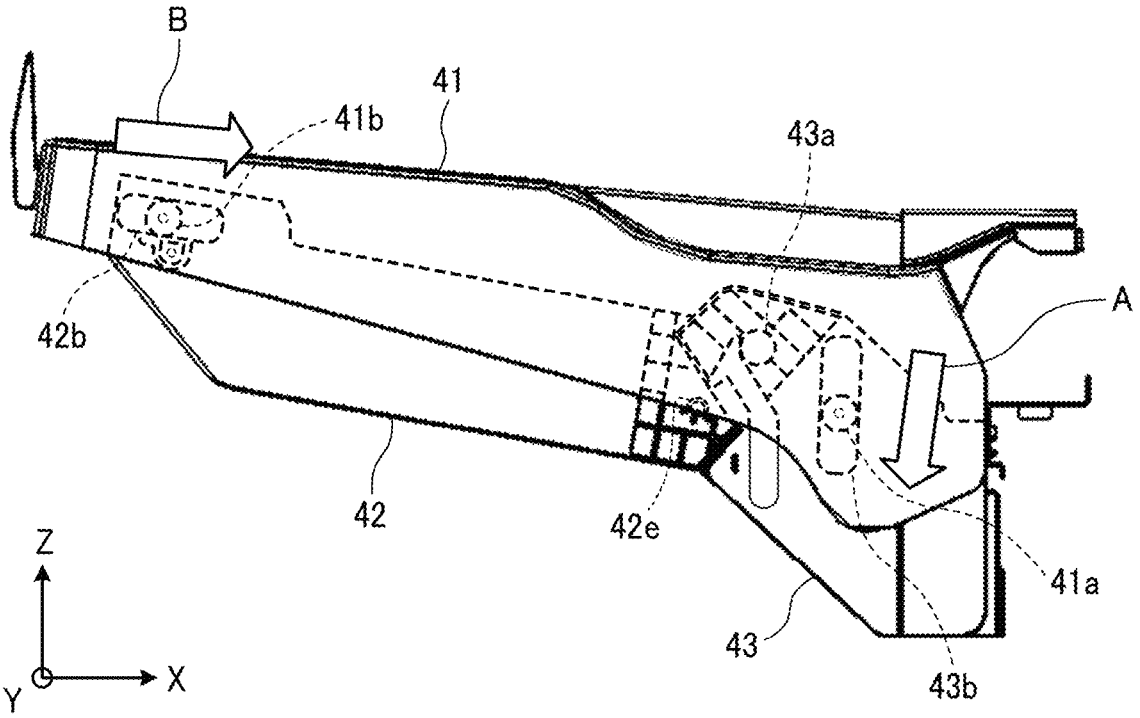
FIG. 6 is a side view illustrating an internal structure of the sheet ejection tray indicating by a broken line.

FIG. 6 is a side view illustrating the sheet ejection device 4 according to the present embodiment of this disclosure, indicating an internal structure of the sheet ejection device 4 by a broken line.

The sheet ejection device 4 according to the present embodiment includes an upper tray unit 41, a lower tray unit 42, a tray securing unit 43, and a slider 44.

The upper tray unit 41 functions as a sheet stacking member having an upper face as a sheet stacking face. The sheets 20 are ejected one by one through a sheet ejection port 2*a* that functions as a sheet conveying portion formed in a housing side face 2 of the housing of the image forming apparatus 1. The sheets 20 are sequentially ejected and stacked onto the upper face of the upper tray unit 41. The upper tray unit 41 has an upstream portion in a sheet conveyance direction (that is, a right-side in FIG. 4). The upstream portion in the sheet conveyance direction of the upper tray unit 41 is supported by the lower tray unit 42 to be movable in a vertical direction. Hereinafter, the upstream portion in the sheet conveyance direction of the upper tray unit 41 is simply referred to as the "upstream portion."

The tray securing unit 43 includes a rotary shaft 43*a* extending in a direction perpendicular to the drawing sheet of FIG. 4 (that is, a Y direction indicated by arrow Y), in other words, a rotary shaft 43*a* extending in a horizontal direction perpendicular to the sheet conveyance direction. The lower tray unit 42 is rotatable about the rotary shaft 43*a* of the tray securing unit 43. At the same time, the lower tray unit 42 functions as a rotary support to support the upper tray unit 41 in the vertical direction and is included in an angle setter. That is, as the lower tray unit 42 rotates about the rotary shaft 43*a* of the tray securing unit 43, the upper tray unit 41 that is supported by the lower tray unit 42 also rotates about the rotary shaft 43*a* of the tray securing unit 43. Accordingly, an angle of the top face (the sheet stacking face) of the upper tray unit 41, relative to the face of the sheet 20 that is to be ejected (conveyed) from the sheet ejection port 2*a* (that is, an angle about the rotary shaft 43*a* of the tray securing unit 43), is changed. Hereinafter, the angle is referred to as a "tray angle."

The tray securing unit 43 is a securing member to be fixed to the housing side face 2 of the image forming apparatus 1 and supports each end of the rotary shaft 43*a*. The tray securing unit 43 supports the lower tray unit 42 attached to the rotary shaft 43*a*, to rotate about the rotary shaft 43*a*. As illustrated in FIG. 5, a height adjuster spring 45 is disposed between the tray securing unit 43 and the upper tray unit 41. The height adjuster spring 45 is a compression spring that functions as a biasing member. By applying a biasing force of the height adjuster spring 45, the upper tray unit 41 is biased upwardly, relative to the tray securing unit 43. Note that two height adjuster springs 45 are provided in a direction of the front to back side of the image forming apparatus 1 (that is, the Y direction). However, the number of height adjuster springs 45 are determined arbitrarily.

As illustrated in FIG. 6, the upper tray unit 41 includes an upstream guide projection 41*a* that is formed in an inner side face of the upstream portion of the upper tray unit 41 (that is, an inner wall face in the Y direction) and the tray securing unit 43 includes a vertical guide groove 43*b* that is formed in a side face of the tray securing unit 43 (that is, an outer wall face in the Y direction). The upper tray unit 41 is attached by fitting the upstream guide projection 41*a* to the vertical guide groove 43*b*. The vertical guide groove 43*b* extends substantially in the vertical direction (that is, a Z direction indicated by arrow Z), as illustrated in FIG. 6. Therefore, the tray securing unit 43 supports the upper tray unit 41 so that the upper tray unit 41 is movable in the vertical direction (that is, the Z direction) while regulating movement of the upper tray unit 41 in an X direction indicated by arrow X (that is, a left-to-right direction or horizontal direction of the image forming apparatus 1).

The upper tray unit 41 further includes a downstream side guide projection 41*b* that is formed in the inner side face (that is, the inner wall face in the Y direction) of the downstream side portion in the sheet conveyance direction of the upper tray unit 41 (that is, simply referred to as a "downstream portion"). The downstream side guide projection 41*b* is attached to a horizontal guide groove 42*b* that is formed in the side face (that is, the outer wall face in the Y direction) of the lower tray unit 42. As illustrated in FIG. 6, the horizontal guide groove 42*b* extends substantially in the left-to-right direction of the image forming apparatus 1 (that is, the X direction). Therefore, while regulating movement of the upper tray unit 41 in the Z direction of the upper tray unit 41 (that is, the vertical direction), the lower tray unit 42 supports the upper tray unit 41 to be movable in the left-and-right direction (that is, the X direction).

The upstream portion of the upper tray unit 41 is biased upwardly by the height adjuster spring 45 disposed between the upper tray unit 41 and the tray securing unit 43. In a state in which no sheet 20 is held (stacked) on the upper tray unit 41, the upper tray unit 41 is maintained at the height (the initial height) at which the upstream guide projection 41*a* is pressed against an upper end of the vertical guide groove 43*b* of the tray securing unit 43, by the biasing force of the height adjuster spring 45. Therefore, the upper limit position of the upstream portion of the upper tray unit 41 is regulated by a regulator (another regulator) that includes the upstream guide projection 41*a* and the vertical guide groove 43*b*.

This initial height is set such that the height of the sheet stacking face of the upper tray unit 41 is at the substantially same height as (slightly lower than) the sheet 20 to be ejected (conveyed) through the sheet ejection port 2*a*. In a case in which the height of the sheet stacking face of the upstream portion of the upper tray unit 41 is too low with respect to the sheet 20 to be ejected through the sheet ejection port 2*a*, the leading end of the sheet 20 contacts the sheet stacking face of the upper tray unit 41 while being hanged down by the own weight. Therefore, the trailing end of the sheet 20 comes before the leading end of the sheet 20 in the sheet conveyance direction, and an inconvenience occurs to curl up the sheet 20 into a roll shape. Conversely, in a case in which the height of the sheet stacking face of the upstream portion of the upper tray unit 41 is too high with respect to the sheet 20 to be ejected through the sheet ejection port 2*a*, the leading end of the sheet 20 collides an end face of the upper tray unit 41 prior to the upstream portion of the upper tray unit 41. Therefore, an inconvenience in which the sheet 20 is not conveyed appropriately to the upper tray unit 41 occurs. The initial height of the upper tray unit 41 according to the present embodiment is set to restrain these inconveniences.

Figure 7A:
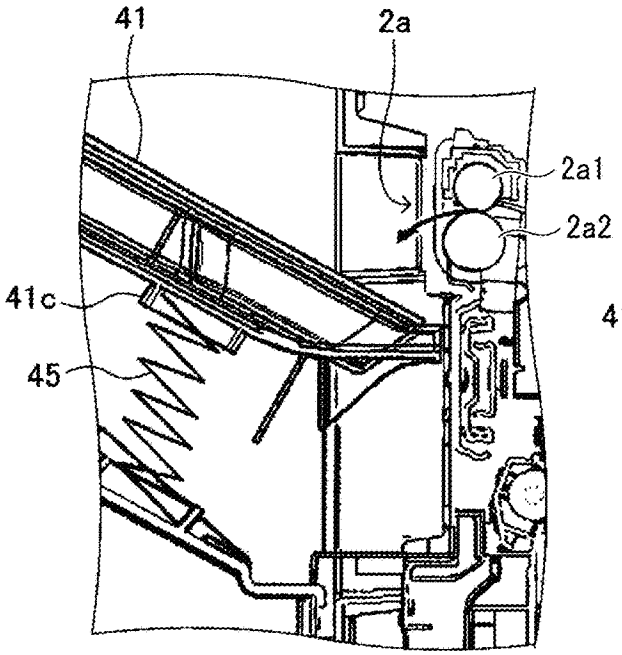
FIGS. 7A, 7B, and 7C are diagrams illustrating sequential states in which an upper tray unit is pressed down along with an increase in a sheet stacking amount of sheets on the upper tray unit.
Figure 7B:
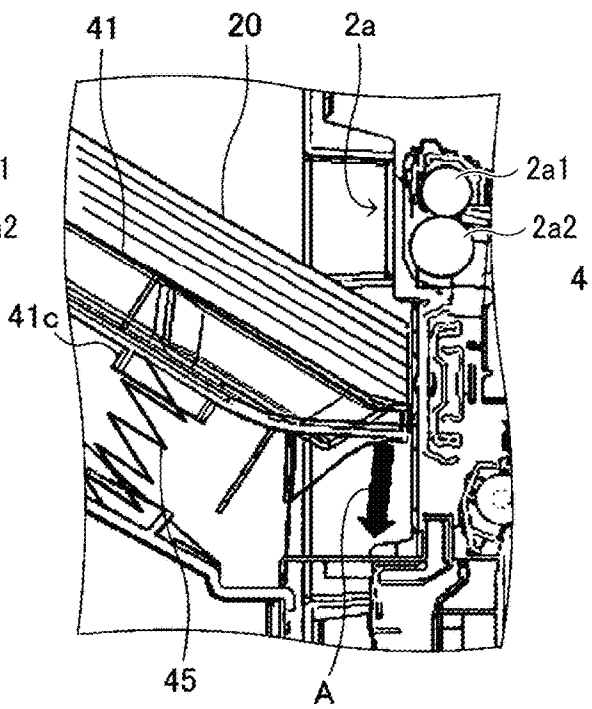
Figure 7C:
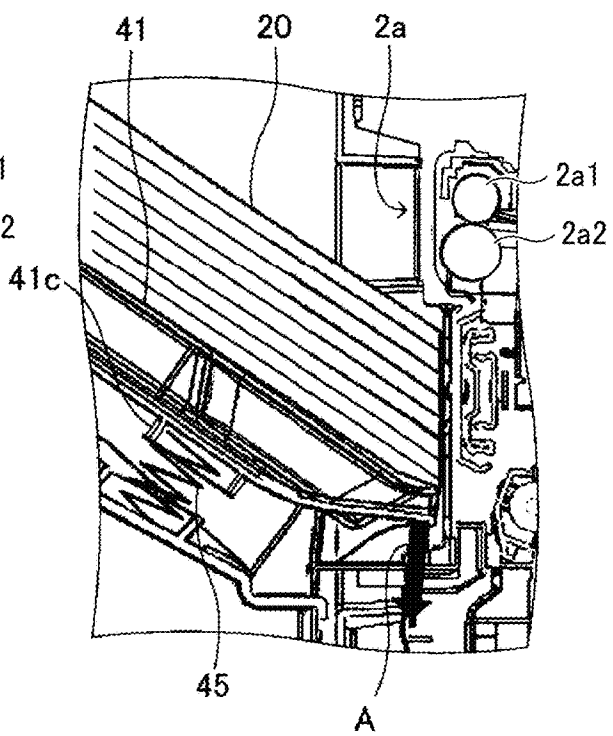

FIGS. 7A, 7B, and 7C are diagrams illustrating sequential states in which the upper tray unit 41 is pressed down along with an increase in a sheet stacking amount of sheets 20 on the upper tray unit 41.

Figure 8:
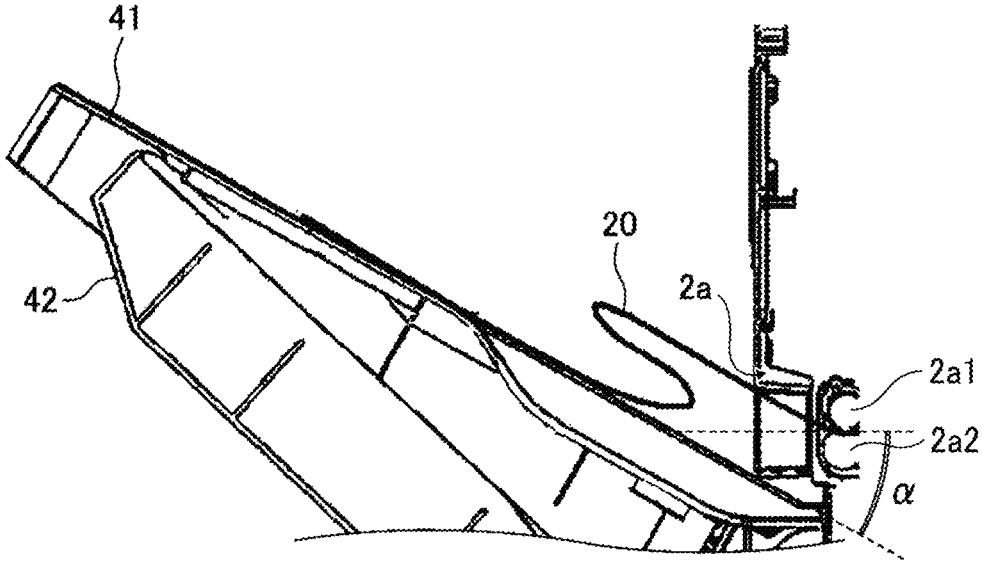
FIG. 8 is a diagram illustrating a state in which the leading end of a sheet contacts a sheet stacking face of the upper tray unit without sliding up along the sheet stacking face and the trailing end of the sheet is fed and curved in a bellows shape.

FIG. 8 is a diagram illustrating a state in which the leading end of the sheet 20 contacts a sheet stacking face of the upper tray unit 41 without sliding up along the sheet stacking face and the trailing end of the sheet 20 is fed and curved in a bellows shape.

When the sheets 20 are sequentially ejected (conveyed) from the sheet ejection port 2*a*, to the upper tray unit 41 at the above-described initial height, due to the own weight of the sheets 20 stacked on the upper tray unit 41, the upper tray unit 41 is pressed down, against the biasing force of the height adjuster spring 45, in a direction indicated by arrow A in FIG. 6. With this action, as illustrated in FIGS. 7A to 7C, the upper tray unit 41 is pressed down as the sheet stacking amount of the sheets 20 on the upper tray unit 41, so that the height of the sheet face of the uppermost sheet P on the upper tray unit 41 is constantly maintained to be substantially the same as (slightly lower than) the height of the sheet 20 to be ejected (conveyed) through the sheet ejection port 2*a*. Therefore, even after the sheets 20 are stacked, the above-described inconvenience is restrained.

In the present embodiment, the extending direction of the vertical guide groove 43*b* provided in the tray securing unit 43 is not completely level to the vertical direction (the direction Z) but is slightly inclined. Specifically, as illustrated in FIG. 6, the position of the lower end side of the vertical guide groove 43*b* in the horizontal direction (the position in the X direction) is farther from the sheet ejection port 2*a*, than the position of the upper end side of the vertical guide groove 43*b*. Thus, the upstream portion of the upper tray unit 41 moves downward while being displaced (shifted) in the X direction to move away from the sheet ejection port 2*a* as the sheet stacking amount of the sheets 20 on the upper tray unit 41 increases. According to this configuration, when the upstream portion of the upper tray unit 41 in the sheet conveyance direction moves downward, the upstream portion of the upper tray unit 41 is prevented from interfering the housing side face 2 of the image forming apparatus 1. Accordingly, the upper tray unit 41 moves stably in the vertical direction.

Note that, in order to move the upper tray unit 41 as described above, the upper tray unit 41 is displaced (shifted) in the X direction, relative to the lower tray unit 42 that supports the downstream side portion of the upper tray unit 41. In the present embodiment, as described above, since the downstream side guide projection 41*b* of the upper tray unit 41 is attached by fitting to the horizontal guide groove 42*b* extending in the X direction of the lower tray unit 42, the upper tray unit 41 is displaced (shifted) in the X direction, relative to the lower tray unit 42, as indicated by arrow B in FIG. 6, which achieves the above-described stable vertical movement.

In recent years, due to diversification of types of sheets, sheets may not be properly stacked on the sheet ejection device 4 depending on the type of sheets. For example, as illustrated in FIG. 5, in a case in which a sheet having a low stiffness and a large contact resistance, such as a coated thin paper, is conveyed to a sheet stacking face that is relatively largely inclined upwardly toward the downstream in the sheet conveyance direction, the leading end of the sheet in contact with the sheet stacking face does not slidably climb up due to the high contact resistance, as illustrated in FIG. 8, and the trailing end of the sheet is fed to bend in a bellows shape due to the low stiffness.

For example, a known post-processing apparatus (that is, a known sheet stacker) includes a configuration in which a sheet ejection tray (that is, a sheet stacking member) moves in a vertical direction driven by a stepping motor. In this sheet post-processing apparatus, the discharge tray is lowered by the stepping motor and the amount of power supplied to the stepping motor is increased as the amount of sheets stacked on the sheet ejection tray increases. In a case in which the post-processing apparatus has performed a sheet folding operation to a sheet to be ejected, the angle of the sheet stacking face of the sheet ejection tray relative to the folded sheet to be ejected is changed to be smaller than the angle of the angle of the sheet stacking face of the sheet ejection tray relative to an unfolded sheet to be ejected. Accordingly, misdetection of the sheet stacking amount of the folded sheets due to a small bulge of a folding portion of the sheet is eliminated, and therefore excessive power supply to the stepping motor is restrained.

A generally known post-processing apparatus, which lowers a sheet stacking member as the sheet stacking amount of sheets on the sheet ejection tray increases, includes a known configuration in which a biasing force applier upwardly biases a sheet stacking member having at least an upstream portion, which is variable in the vertical direction, in a sheet conveyance direction. However, in a case in which this configuration is provided with an angle setting unit that sets the angle of the sheet stacking face of the sheet stacking member in the sheet conveyance direction with respective to a sheet conveying portion to a first angle and a second angle, the sheet stacking performance (that is, the sheet stackability) relative to the sheet stacking member goes worse (deteriorates).

In order to address this inconvenience, to provide the appropriate sheet stackability to various types of sheets including this sheet, a slider 44 that functions as an angle setter to set the angle of the top face (sheet stacking face) of the upper tray unit 41 relative to the surface of the sheet 20 to be ejected (conveyed) from the sheet ejection port 2*a*.

Figure 9:
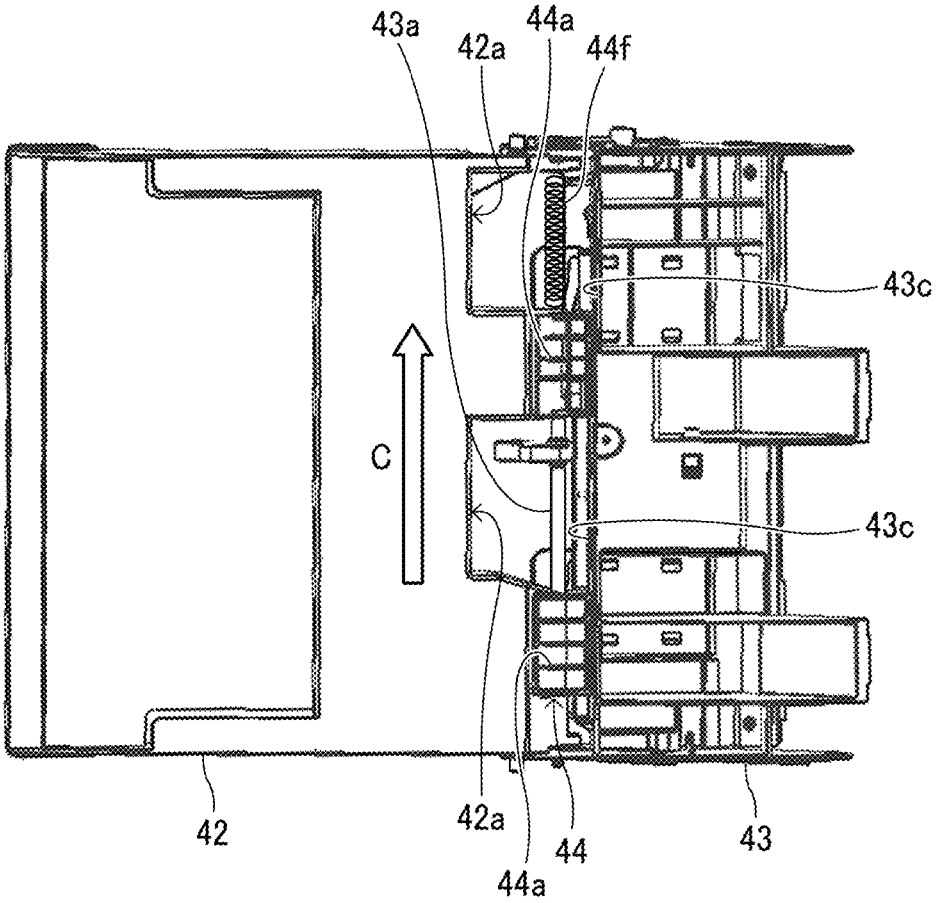
FIG. 9 is a bottom view illustrating the sheet ejection tray with the upper tray unit being removed.

FIG. 9 is a bottom view illustrating the sheet ejection device 4 with the upper tray unit 41 being removed.

Figure 10A:
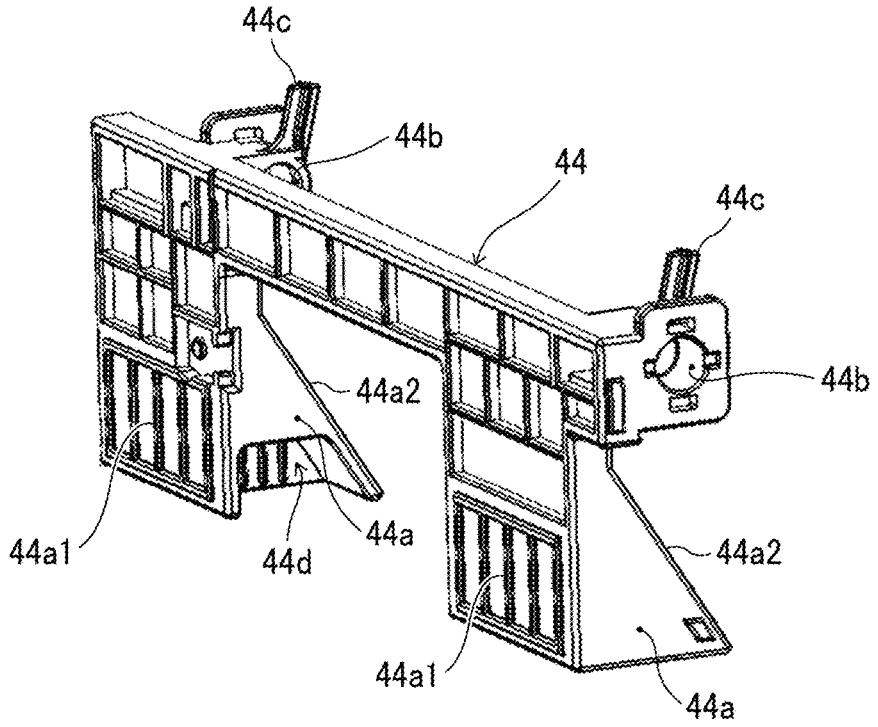
FIG. 10A is a perspective view illustrating a slider, viewed from a direction.
Figure 10B:
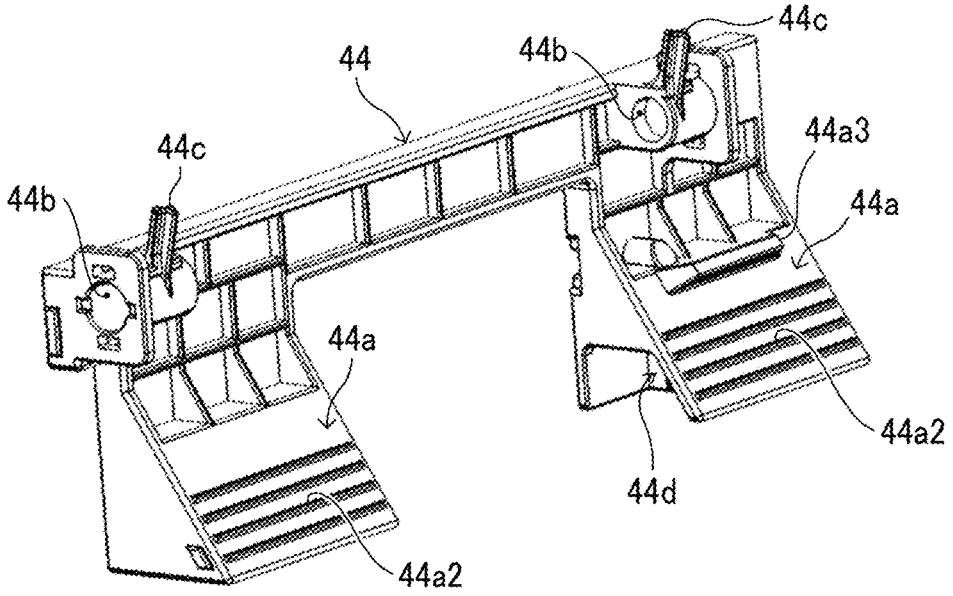
FIG. 10B is a perspective view illustrating the slider, viewed from another direction different from the direction of FIG. 10A.
Figure 10C:
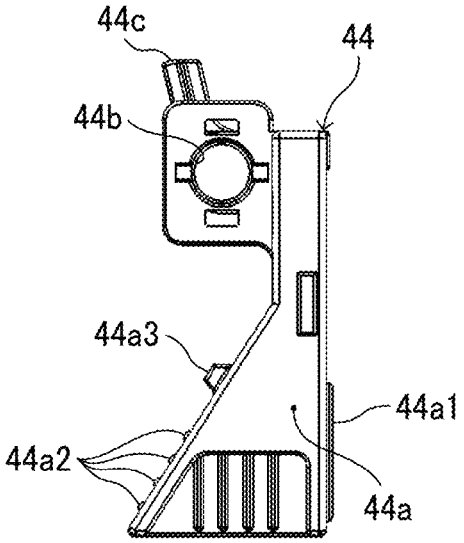
FIG. 10C is a side view illustrating the slider, viewed from the axial direction of a rotary shaft.

FIGS. 10A and 10B are perspective views illustrating the slider 44, viewed from different directions from each other. FIG. 10C is a side view illustrating the slider 44, viewed from the axial direction of the rotary shaft 43*a*.

The slider 44 is attached to the tray securing unit 43 by inserting the rotary shaft 43*a* of the tray securing unit 43 into bearing holes 44*b* of the slider 44, so that the slider 44 slides along the axial direction (the Y direction) of the rotary shaft 43*a*. The slider 44 includes tray receiving portions 44*a*, each having a sliding face 44*a*1. The slider 44 slides in the Y direction while causing the sliding face 44*a*1 of the tray receiving portion 44*a* of the slider 44 to slide on a sliding target face 43*c* of the tray securing unit 43.

When the tray angle is a first angle α as illustrated in FIGS. 5 and 8, the slider 44 is located at a first position (position in the Y direction) as illustrated in FIGS. 3 and 9. At this time, even when the downstream side portion of the upper tray unit 41 is attempted to rotate, together with the lower tray unit 42, about the rotary shaft 43*a* in a downward direction due to the own weight, a contact face 42*c* of the lower tray unit 42 contacts a contact target face 44*a*2 of the tray receiving portion 44*a* of the slider 44 so as to regulate the rotation of the downstream side portion of the upper tray unit 41. According to this action, the upper tray unit 41 is positioned to have the tray angle to be the first angle α. Contact of a rotation stopper 42*e* that is mounted on the side face of the lower tray unit 42 to the tray securing unit 43 regulates the lower tray unit 42 from rotating about the rotary shaft 43*a* in a direction to further increase the tray angle beyond the first angle α.

Figure 11:
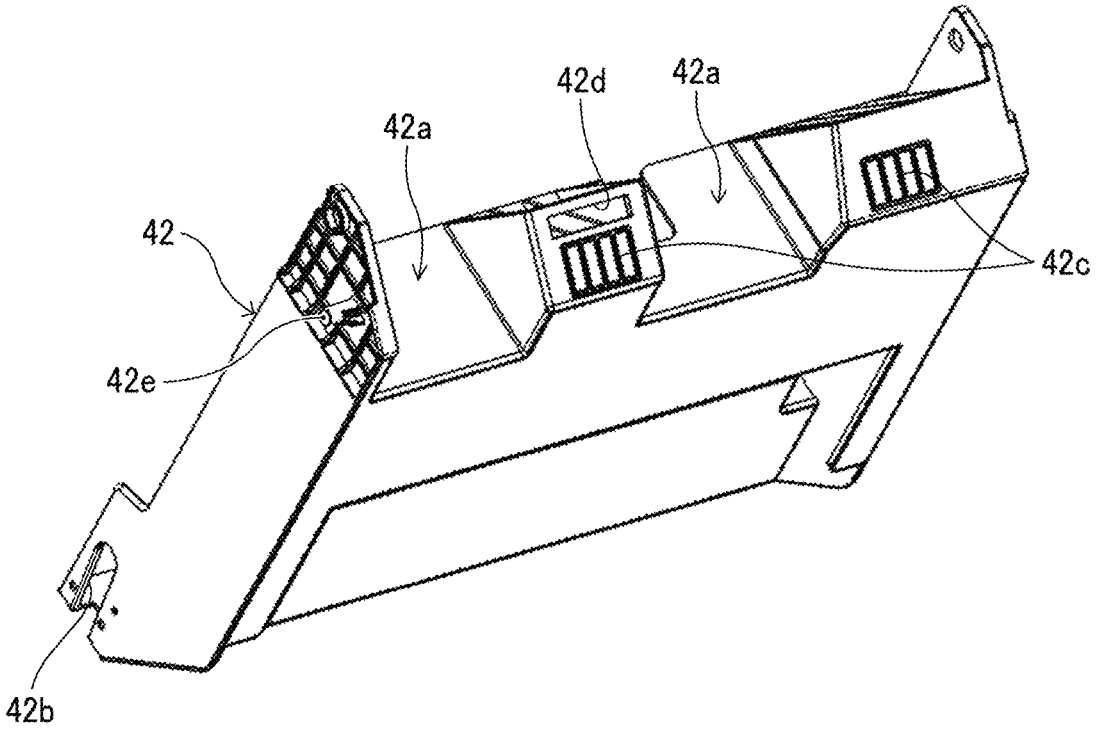
FIG. 11 is a perspective view illustrating a lower tray unit, viewed from obliquely below.

FIG. 11 is a top view illustrating the tray securing unit 43 of the image forming apparatus 1.

Figure 12:
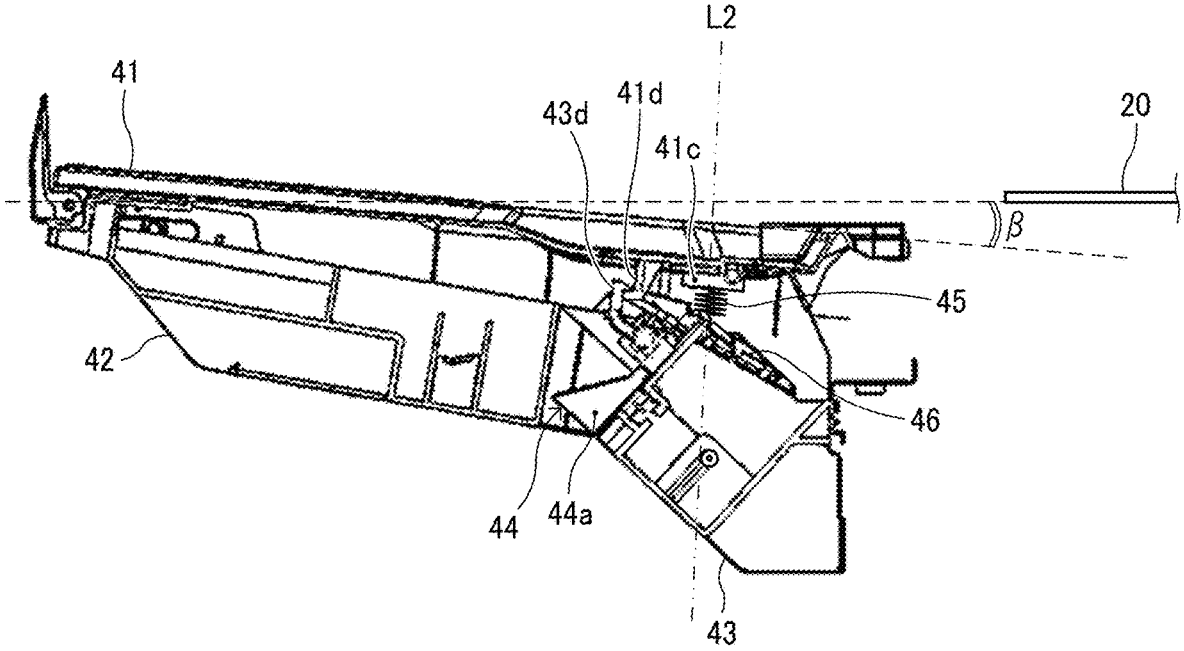
FIG. 12 is a cross-sectional view illustrating the sheet ejection tray having a second angle β as a tray angle, when the sheet ejection tray is cross-sectioned along the sheet conveyance direction.

FIG. 12 is a cross-sectional view illustrating the sheet ejection device 4 having a second angle β as a tray angle, when the sheet ejection device 4 is cross-sectioned along the sheet conveyance direction.

In a case in which the contact face 42*c* of the lower tray unit 42 and the contact target face 44*a*2 of the slider 44 are flat faces (plane), it is difficult to maintain the parallelism between the contact face 42*c* of the lower tray unit 42 and the contact target face 44*a*2 of the slider 44 due to manufacturing errors. Therefore, the contact state of the contact face 42*c* and the contact target face 44*a*2 does not stabilize, and the lower tray unit 42 rattles. In order to avoid this inconvenience, in the present embodiment, while a plurality of ribs extending in a direction perpendicular to the Y direction are mounted on the contact face 42*c* of the lower tray unit 42, as illustrated in FIG. 11, a plurality of ribs extending in the Y direction are mounted on the contact target face 44*a*2 of the slider 44, as illustrated in FIG. 10B. As described above, by contacting the plurality of ribs extending in different directions intersecting with each other, when compared with a configuration in which the flat faces contact with each other, the contact state of the contact face 42*c* of the lower tray unit 42 and the contact target face 44*a*2 of the slider 44 is easily stabilized, and therefore the rattle of the lower tray unit 42 is restrained.

On the other hand, when the tray angle is changed to a second angle β that is smaller than the first angle α, as illustrated in FIG. 12, a user pinches a handle 44*d* of the slider 44 to slide the slider 44 toward the front side of the image forming apparatus 1 along the Y direction (that is indicated by arrow C in FIGS. 3 and 9). Then, when the contact target face 44*a*2 of the tray receiving portion 44*a* of the slider 44 slidably reaches a second position (position in the Y direction) to displace (shift) from the opposing position to the contact face 42*c* of the lower tray unit 42, the tray receiving portion 44*a* comes to face a storage recess 42*a* of the lower tray unit 42. Therefore, even though the lower tray unit 42 has been restricted from rotating about the rotary shaft 43*a* in a direction to which the downstream side portion of the lower tray unit 42 lowers by the own weight, this restriction is canceled according to this configuration. As a result, the lower tray unit 42 rotates until the contact face 42*c* of the lower tray unit 42 contacts the sliding target face 43*c* of the tray securing unit 43, the rotation of the lower tray unit 42 is regulated due to the contact, and the upper tray unit 41 is positioned to have the tray angle of the second angle β that is smaller than the first angle α.

Figure 13:
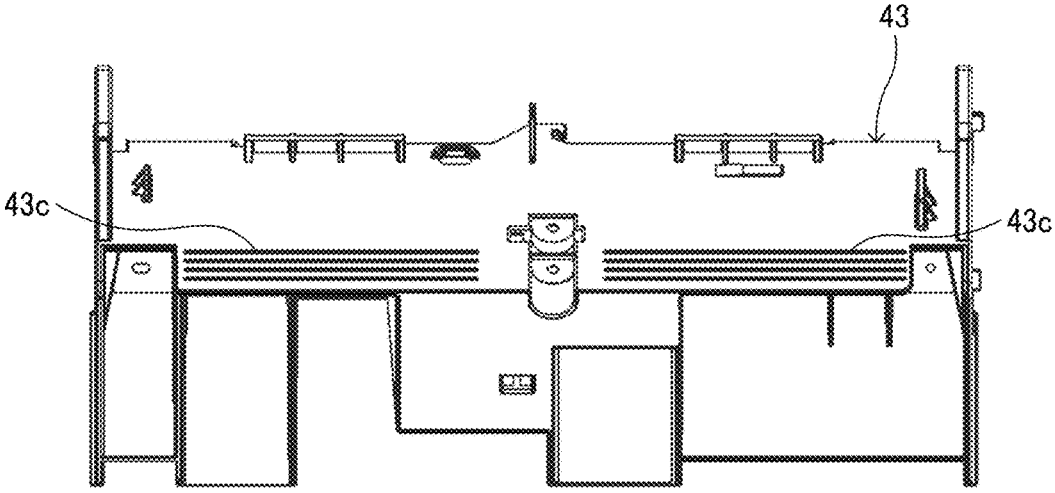
FIG. 13 is a top view illustrating a tray securing unit of the image forming apparatus.

FIG. 13 is a top view illustrating the tray securing unit 43 of the image forming apparatus 1.

In a case in which the contact face 42*c* of the lower tray unit 42 and the sliding target face 43*c* of the tray securing unit 43 are flat faces (plane), it is difficult to maintain the parallelism between the contact face 42*c* of the lower tray unit 42 and the sliding target face 43*c* of the tray securing unit 43 due to manufacturing errors. Therefore, the contact state of the contact face 42*c* and the sliding target face 43*c* does not stabilize, and the lower tray unit 42 rattles. In the present embodiment, the plurality of ribs extending in the direction orthogonal to the Y direction are mounted on the contact face 42*c* of the lower tray unit 42, as described above. Therefore, as illustrated in FIG. 13, a plurality of ribs extending in the Y direction are provided on the sliding target face 43*c* of the tray securing unit 43. As described above, by contacting the plurality of ribs extending in different directions intersecting with each other, when compared with a configuration in which the flat faces contact with each other, the contact state of the contact face 42*c* of the lower tray unit 42 and the sliding target face 43*c* of the tray securing unit 43 is easily stabilized, and therefore the rattle of the lower tray unit 42 is restrained.

With respect to the sliding target face 43*c* of the tray securing unit 43 that contacts the contact face 42*c* of the lower tray unit 42 when the tray angle is the second angle β, in a case in which the slider 44 moves, the sliding face 44*a*1 of the slider 44 slides on the sliding target face 43*c* of the tray securing unit 43. Therefore, in the present embodiment, in order to reduce the sliding resistance and obtain the high slidability, the plurality of ribs on the sliding target face 43*c* extends in a (parallel) direction substantially same as a sliding direction in which the sliding face 44*a*1 of the slider 44 slides.

In the present embodiment, the first angle α is in a range of an angle applied when stacking general sheets (for example, the angle about 30° C.). When the tray angle is the first angle α as described above, when a sheet having a low stiffness and a large contact resistance, such as a coated thin paper, is conveyed, the leading end of the sheet in contact with the sheet stacking face of the upper tray unit 41 does not slidably climb up due to the high contact resistance and the trailing end of the sheet is fed to bend in a bellows shape due to the low stiffness.

According to the present embodiment, when a sheet having a low stiffness and a large contact resistance, such as coated thin paper, is conveyed, the slider 44 is slid from the first position to the second position to set the tray angle to the second angle β that is smaller than the first angle α. Accordingly, the angle of the upper face of the upper tray unit 41 becomes smaller (becomes parallel) with respect to the surface of the sheet 20 to be ejected (conveyed) through the sheet ejection port 2*a*. Therefore, even when a sheet having a high contact resistance and a low stiffness, such as a coated thin paper, is conveyed, the sheet stacking face of the upper tray unit 41 or the leading end of the sheet in contact with the sheet stacking face of the upper tray unit 41 slidably climbs up due to the feeding of the trailing end of the sheet, thereby restraining the bend of the sheet in a bellows shape.

The upper tray unit 41 has a spring receiving recess 41*c* to receive one end of the height adjuster spring 45. Here, when the tray angle is changed from the first angle α to the second angle β, the upper tray unit 41 rotates about the rotary shaft 43*a* via the lower tray unit 42. Consequently, the posture (angle) of the spring receiving recess 41*c* of the upper tray unit 41 changes, and therefore the spring receiving recess 41*c* of the upper tray unit 41 also changes. If this change is large, the biasing force of the height adjuster spring 45 acting on the spring receiving recess 41*c* of the upper tray unit 41 changes. As a result, when the tray angle is the second angle β, the height of the upstream portion of the upper tray unit 41 shifts from the target height, and therefore the sheet stacking performance (the sheet stackability) is degraded.

Specifically, when the tray angle is the second angle β, due to the change in the biasing force of the height adjuster spring 45, the height of the sheet stacking face of the upstream portion of the upper tray unit 41 or the height of the surface of the uppermost sheet on the upper tray unit 41 may be too low, with respect to the sheet 20 to be conveyed through the sheet ejection port 2*a*, for example. In this case, the leading end of the sheet 20 contacts the sheet stacking face of the upper tray unit 41 or the surface of the uppermost sheet while being hanged down by the own weight. Due to this contact of the sheet 20 with the upper tray unit 41 or the uppermost sheet, the trailing end of the sheet 20 comes before the leading end of the sheet 20 in the sheet conveyance direction, resulting in an inconvenience that the sheet 20 is curled up into a roll shape. Consequently, the sheet 20 is not conveyed appropriately.

Conversely, in a case in which he height of the sheet stacking face of the upper tray unit 41 or the height of the uppermost sheet is too high, the leading end of the sheet 20 collides the end face of the upper tray unit 41 or an end face of the sheet bundle loaded on the upper tray unit 41 prior to the upstream portion of the upper tray unit 41. Therefore, the sheet 20 is not conveyed appropriately to the upper tray unit 41.

In order to address this inconvenience, the sheet ejection device 4 according to the present embodiment includes a biasing force change reducer to reduce (restrain) the change of the biasing force acting on the upper tray unit 41 before and after the change of the tray angle. With this configuration, even if the tray angle is changed to the second angle β, the biasing force acting on the upper tray unit 41 does not largely change from the first angle α. Specifically, the biasing force change reducer according to the present embodiment includes a spring receiver 46 that functions as a coupling portion provided on the tray securing unit 43 to couple the tray securing unit 43 with the height adjuster spring 45. The biasing force change reducer changes the position of the spring receiver 46 before and after the change of the tray angle of the upper tray unit 41.

Figure 14A:
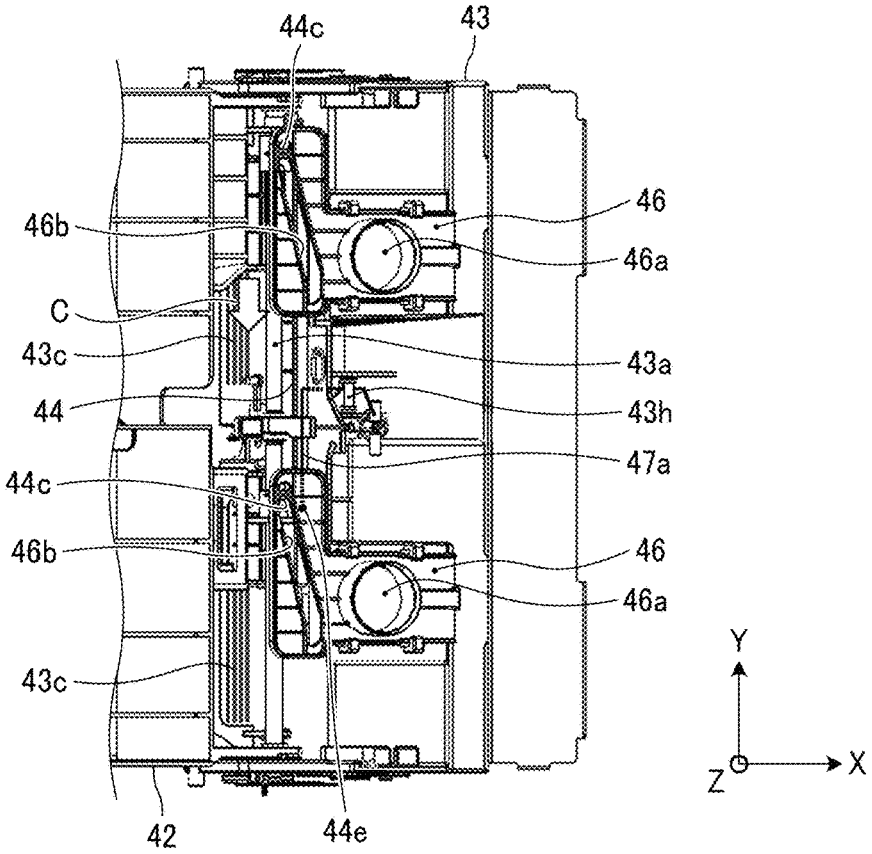
FIG. 14A is a top view illustrating the sheet ejection tray having the first angle α when the upper portion and a height adjuster spring are removed.
Figure 14B:
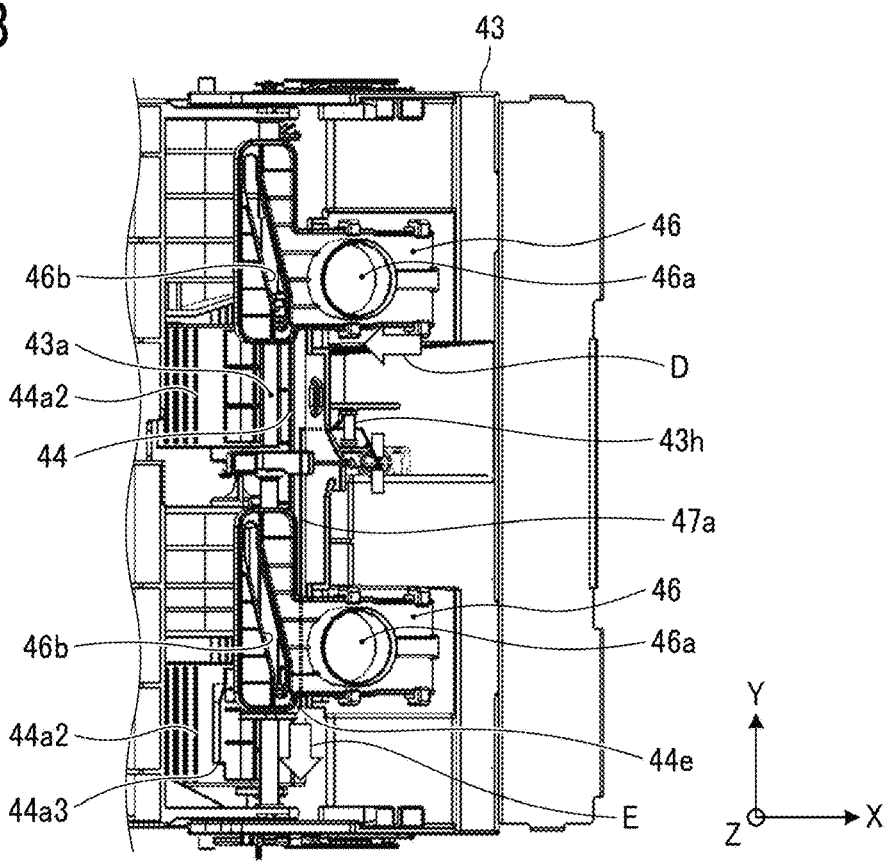
FIG. 14B is a top view illustrating the sheet ejection tray having the second angle β when the upper portion and the height adjuster spring are removed.

FIGS. 14A and 14B are top views of the sheet ejection device 4 without the upper tray unit 41 and the height adjuster spring 45. Specifically, FIG. 14A illustrates the position of the spring receiver 46 when the tray angle of the upper tray unit 41 is at the first angle α and FIG. 14B illustrates the position of the spring receiver 46 when the tray angle of the upper tray unit 41 is at the second angle β.

Figure 15A:
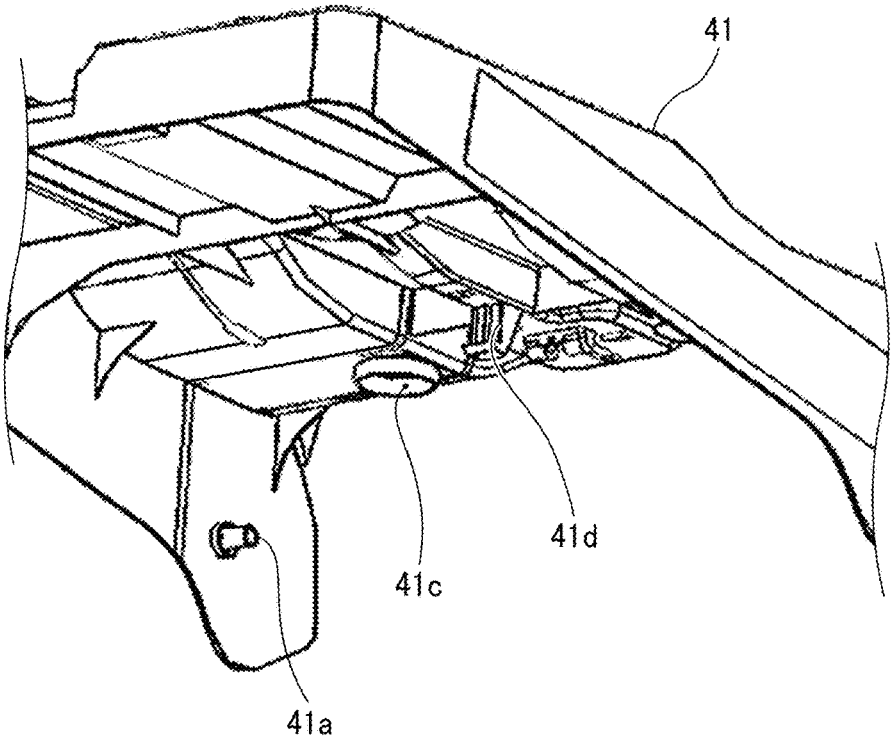
FIG. 15A is a perspective view illustrating the upper tray unit, viewed from a direction.
Figure 15B:
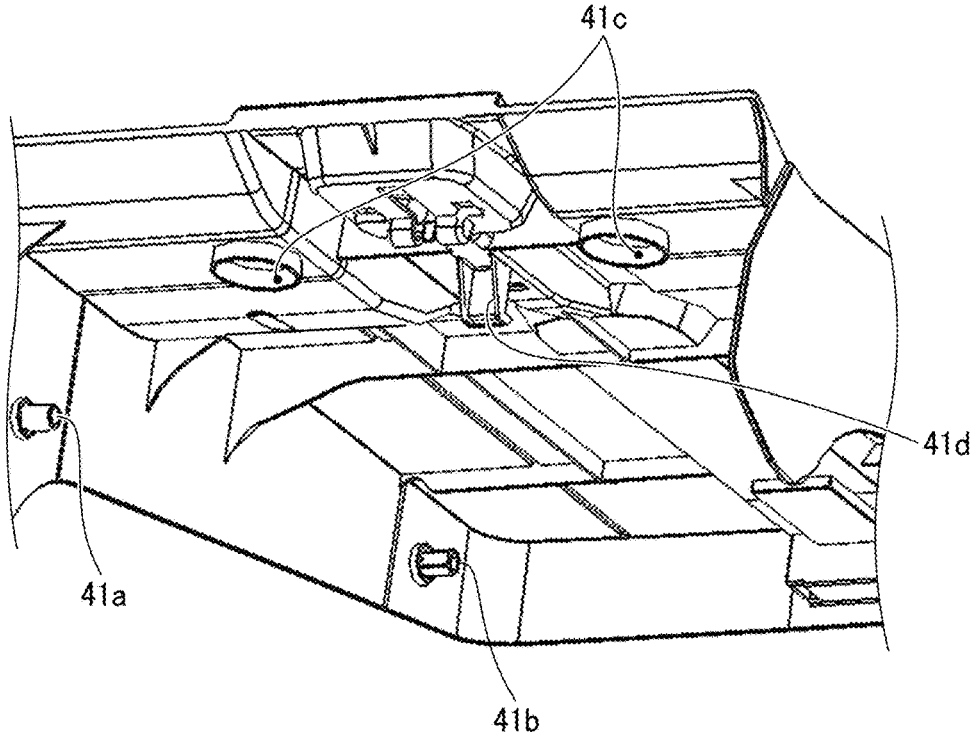
FIG. 15B is a perspective view illustrating the upper tray unit, viewed from another direction different from the direction of FIG. 15A.

Further, FIGS. 15A and 15B are perspective views illustrating the upper tray unit 41, viewed from respective directions different from each other.

In the present embodiment, a lower end portion of the height adjuster spring 45 (that is, an end portion coupled to the tray securing unit 43) between the tray securing unit 43 and the upper tray unit 41 is disposed and held in a recess 46*a* of each of the spring receivers 46 that are held on the tray securing unit 43. Note that an upper end portion of the height adjuster spring 45 (that is, an end portion coupled to the upper tray unit 41) is disposed and held in the spring receiving recess 41*c* formed in the upper tray unit 41 as illustrated in FIGS. 15A and 15B.

Each of the spring receiving recesses 41*c* (in other words, each spring receiving recess 41*c*) has a receiving face to hold the upper end of the height adjuster spring 45. When the tray angle is the first angle α, the orientation of the receiving face of each spring receiving recess 41*c* of the upper tray unit 41 that holds the upper end of the height adjuster spring 45 directs in a direction indicated by reference letter L1 with a two-dot chain line (in other words, a line L1) in FIG. 5. On the other hand, when the upper tray unit 41 rotates about the rotary shaft 43*a* via the lower tray unit 42 to change the tray angle from the first angle α to the second angle β, the orientation of the receiving face of each spring receiving recess 41*c* of the upper tray unit 41 that holds the upper end of the height adjuster spring 45 directs in a direction indicated by reference letter L2 with a two-dot chain line (in other words, a line L2) in FIG. 12.

According to this configuration, in this embodiment, the position at which the line L2 passes through the tray securing unit 43 when the tray angle is the second angle β (see FIG. 12) is displaced (shifted) upstream in the sheet conveyance direction, far from the position at which the line L1 passes through the tray securing unit 43 at the first angle α when the tray angle is the first angle α (see FIG. 5). Due to this displacement (shift), the attitude (angle) of the height adjuster spring 45 with respect to the spring receiving recess 41*c* of the upper tray unit 41 changes, and the biasing force of the height adjuster spring 45 acting on the spring receiving recess 41*c* of the upper tray unit 41 also changes.

Therefore, in the present embodiment, the spring receivers 46 that receive and hold the respective lower ends of the height adjuster springs 45 are disposed to be slidable along substantially the X direction (the sheet conveyance direction) of the tray securing unit 43. Specifically, when the tray angle is the first angle α, each spring receiver 46 moves to a position illustrated in FIG. 14A. On the other hand, when the tray angle is the second angle β, each spring receiver 46 moves to a position illustrated in FIG. 14B. Accordingly, as the lower end of the height adjuster spring 45 displaces (shifts) in the sheet conveyance direction due to the change in the tray angle, the spring receiver 46 that receives the lower end of the height adjuster spring 45 also displaces (shifts) in the same direction as the lower end of the height adjuster spring 45. This movement restrains the change in the attitude (angle) of the height adjuster spring 45 with respect to the spring receiving recess 41*c* of the upper tray unit 41, and therefore reduces the change in the biasing force of the height adjuster spring 45 acting on the spring receiving recess 41*c* of the upper tray unit 41.

Further, the spring receiver 46 according to the present embodiment is configured to move (slide) along with movement of the slider 44 that moves when changing the tray angle. In other words, the position of the spring receiver 46 changes along with movement of the slider 44. Specifically, as illustrated in FIGS. 14A and 14B, a projection 44*c* mounted on the slider 44 is engaged with a guide groove 46*b* mounted on the spring receiver 46. When the slider 44 slides from the first position (the first angle α) illustrated in FIG. 14A to the second position (the second angle β) illustrated in FIG. 14B (in a direction indicated by arrow C in FIG. 14A), the projection 44*c* that moves along the above-described movement of the slider 44 moves along the guide groove 46*b*. Accordingly, the spring receiver 46 moves in a direction indicated by arrow D in FIG. 14B. The guide groove 46*b* has a shape inclined to the sliding direction (that is, the Y direction) and the sheet conveyance direction (that is, the X direction). This shape of the guide groove 46*b* leads to achievement of the above-described interlocked movements.

Note that, in the configuration of the present embodiment, the spring receiver 46 that receives the lower end of the height adjuster spring 45 moves. However, in stead of this configuration, the spring receiving recess 41*c* that receives the upper end of the height adjuster spring 45.

Here, in the present embodiment, the height adjuster spring 45 is used to lower the upper tray unit 41 appropriately according to the sheet stacking amount when the tray angle is the first angle α. In the present embodiment, when the tray angle is changed from the first angle α to the second angle β, the upper tray unit 41 rotates about the rotary shaft 43*a* via the lower tray unit 42, so that the spring receiving recess 41*c* of the upper tray unit 41 that receives the upper end of the height adjuster spring 45 approaches the spring receiver 46 of the tray securing unit 43. Therefore, as the tray angle is changed from the first angle α to the second angle β, the biasing force applied by the height adjuster spring 45 to the upper tray unit 41 increases. Therefore, the biasing force of the height adjuster spring 45 acting on the spring receiving recess 41*c* of the upper tray unit 41 changes. As a result, when the tray angle is the second angle β, the upstream portion of the upper tray unit 41 is higher than the target position, which degrades the sheet stacking performance (sheet stackability).

In the present embodiment, the sheet ejection device further includes a regulator to regulate the upper height limit position of the upstream portion of the upper tray unit 41 so that the height of the upstream portion of the upper tray unit 41 at the first angle α is substantially the same as the height of the upstream portion of the upper tray unit 41 at the second angle β, in a state in which no sheet is stacked on the sheet stacking face of the upper tray unit 41. In other words, the regulator of the sheet ejection device 4 regulates the upstream portion in the sheet conveyance direction of the upper tray unit 41 at the first angle α to be substantially an equal upper height limit position to the upstream portion in the sheet conveyance direction of the sheet stacking member at the second angle β.

To be more specific about this configuration, when the tray angle is the first angle α, the upstream guide projection 41*a* of the upper tray unit 41 is pressed against (is in contact with) the upper end of the vertical guide groove 43*b* of the tray securing unit 43 due to the biasing force of the height adjuster spring 45, to regulate the upper limit height position of the upstream portion of the upper tray unit 41, as described above. On the other hand, when the tray angle is changed from the first angle α to the second angle β, the upper tray unit 41 rotates about the rotary shaft 43*a* via the lower tray unit 42. With this action, the upstream end portion of the upper tray unit 41 that is located upstream from the rotary shaft 43*a* in the sheet conveyance direction moves upward. For this reason, while the upstream guide projection 41*a* of the upper tray unit 41 remains pressed against the upper end of the vertical guide groove 43*b* of the tray securing unit 43, the height of the upstream portion of the upper tray unit 41 in the initial state (that is, a sheet unloaded state) changes to be higher than when the tray angle is the first angle α.

Therefore, the sheet ejection device 4 according to the present embodiment includes another upper limit height position regulator that is a separate member from the vertical guide groove 43*b* of the tray securing unit 43, so that the height of the upstream portion of the upper tray unit 41 at the second angle β is substantially the same as the height of the upstream portion of the upper tray unit 41 at the first angle α in a state in which no sheet is stacked on the sheet stacking face of the upper tray unit 41.

Figure 16A:
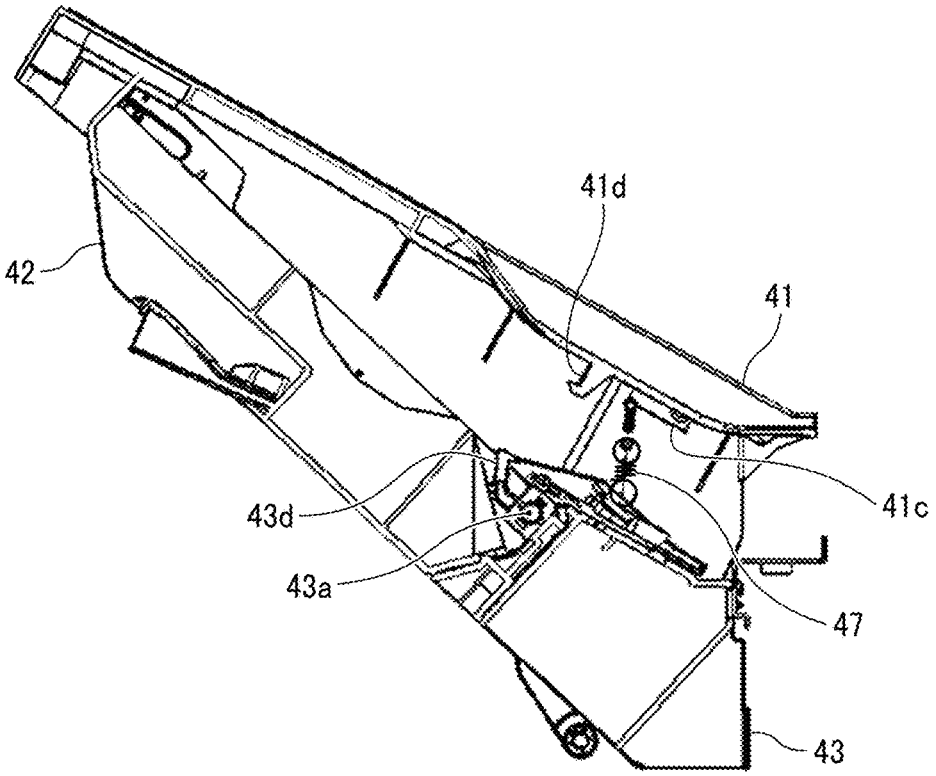
FIGS. 16A and 16B are cross-sectional views illustrating the sheet ejection tray that is cross-sectioned in a direction orthogonal to the sheet conveyance direction to indicate a regulator for a tray angle of the second angle β.
Figure 16B:
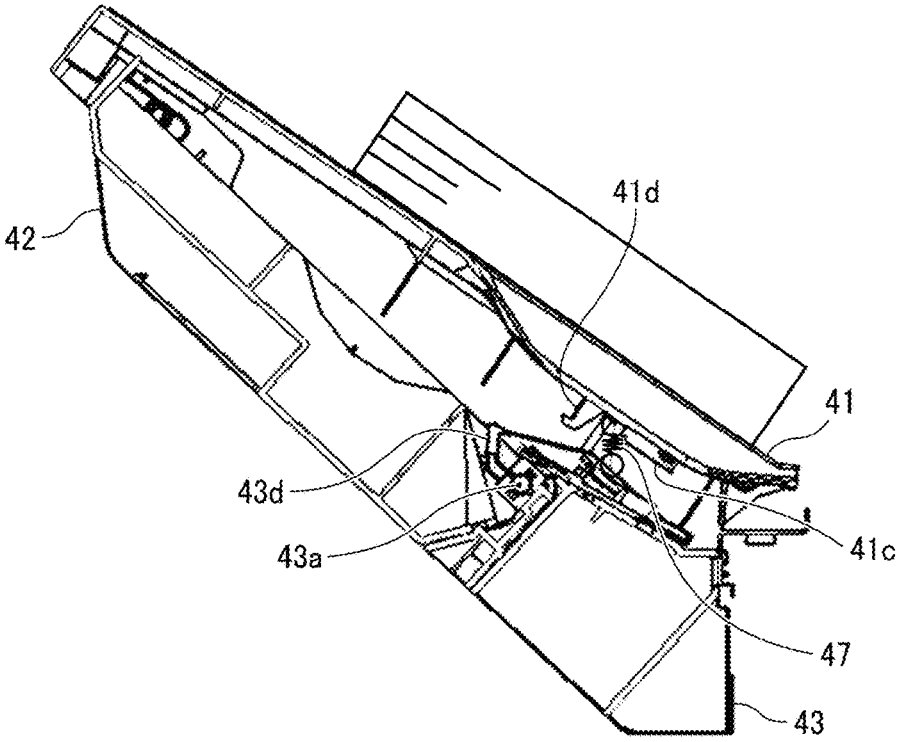

FIGS. 16A and 16B are cross-sectional views illustrating the sheet ejection device 4 that is cross-sectioned in a direction orthogonal to the sheet conveyance direction to indicate a regulator for a tray angle of the second angle β.

In the present embodiment, the sheet ejection device 4 further includes an upper limit regulator hook 43*d* that functions as an upper limit regulation member and a tray side hook 41*d* that functions as an upper limit regulation target member. The upper limit regulator hook 43*d* is mounted on the rotary shaft 43*a*. The tray side hook 41*d* is mounted on the upper tray unit 41 and is engaged with the upper limit regulator hook 43*d* when the tray angle is the second angle β. When the tray angle is the first angle α, the tray side hook 41*d* of the upper tray unit 41 is separated from the upper limit regulator hook 43*d* mounted on the rotary shaft 43*a* of the tray securing unit 43, even in the initial state as illustrated in FIG. 16A or a sheet stacking state in which a sheet bundle 20*a* including a plurality of sheets 20 is stacked (that is, a state in which the upstream guide projection 41*a* is pressed against the lower end of the vertical guide groove 43*b*) as illustrated in FIG. 16B. Accordingly, when the tray angle is the first angle α, the tray side hook 41*d* of the upper tray unit 41 does not engage with the upper limit regulator hook 43*d* of the tray securing unit 43, and therefore does not regulate the upper limit height position of the upstream portion of the upper tray unit 41, which is a non-regulating state.

On the other hand, when the tray angle is changed from the first angle α to the second angle β, the upper tray unit 41 rotates about the rotary shaft 43*a* via the lower tray unit 42. With this action, the tray side hook 41*d* that is disposed downstream the rotary shaft 43*a* in the sheet conveyance direction and upper than the rotary shaft 43*a* moves toward downstream in the sheet conveyance direction while moving downward. Then, in the state of the second angle β, as the upper tray unit 41 is pressed down while the upstream guide projection 41*a* of the upper tray unit 41 is regulated by the vertical guide groove 43*b* against the biasing force of the height adjuster spring 45, the tray side hook 41*d* of the upper tray unit 41 engages with the upper limit regulator hook 43*d* mounted on the rotary shaft 43*a* of the tray securing unit 43, as illustrated in FIG. 12. After the upper tray unit 41 has been engaged with the upper limit regulator hook 43*d*, the tray side hook 41*d* is regulated by the upper limit regulator hook 43*d*, so that the upper tray unit 41 is not displaced (shifted) further upward from the upper limit regulator hook 43*d*, which is a regulating state.

Note that, although a single set of the tray side hook 41*d* and the upper limit regulator hook 43*d* is provided substantially at the center in the sheet width direction of the upper tray unit 41 in the present embodiment, a plurality of sets of the tray side hook 41*d* and the upper limit regulator hook 43*d* may be provided in the sheet width direction. However, in a case in which a plurality of sets of the tray side hook 41*d* and the upper limit regulator hook 43*d* is provided in the sheet width direction, for example, if some sets of the tray side hook 41*d* and the upper limit regulator hook 43*d* may not be regulated when making the upper tray unit 41 to the regulating state, the whole sets are unlikely to achieve the appropriate regulating states. On the other hand, if some sets of the tray side hook 41*d* and the upper limit regulator hook 43*d* may not be unregulated, the whole sets are unlikely to achieve the appropriate non-regulating states. Accordingly, the configuration in which a single set of the tray side hook 41*d* and the upper limit regulator hook 43*d* is provided substantially at the center in the sheet width direction reduces of prevents the above-described inconveniences.

Figure 17:
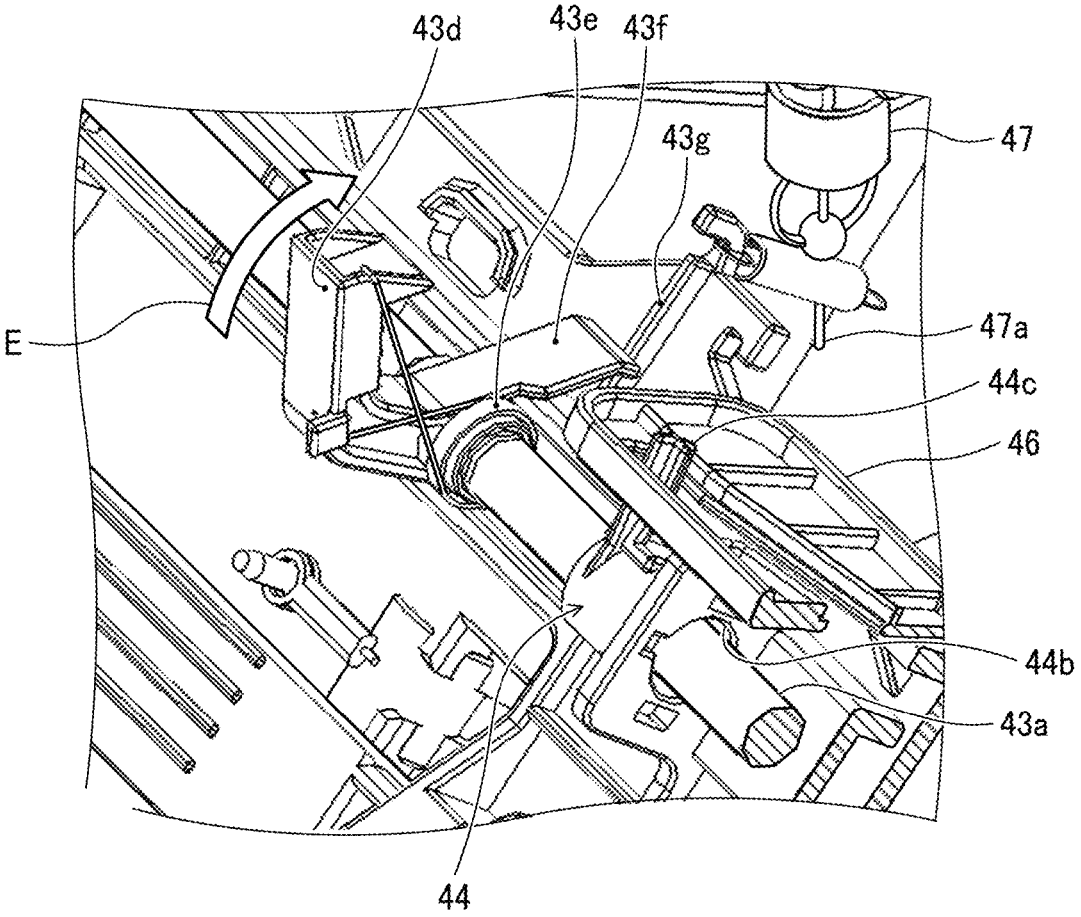
FIG. 17 is a perspective view illustrating a torsion spring that biases an upper limit regulator hook around the rotary shaft.

FIG. 17 is a perspective view illustrating a torsion spring 43*e* that biases the upper limit regulator hook 43*d* around the rotary shaft 43*a*.

Figure 18A:
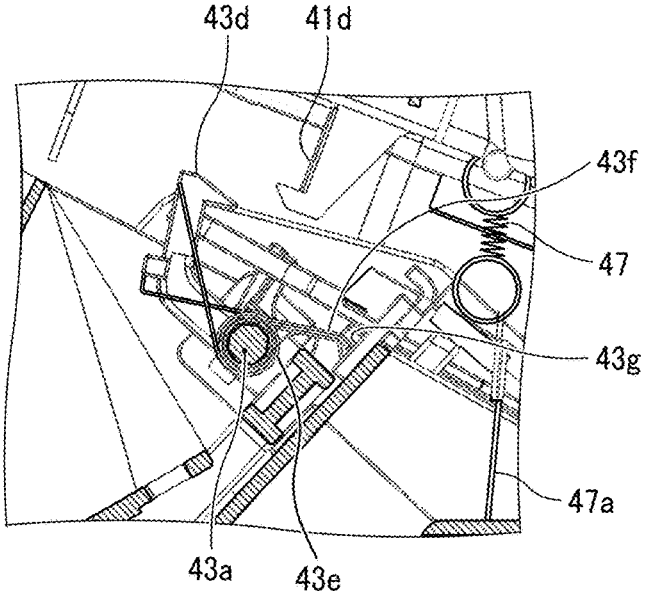
FIGS. 18A, 18B, and 18C are diagrams illustrating respective states of a tray side hook of the upper tray unit engaging the upper limit regulator hook.
Figure 18B:
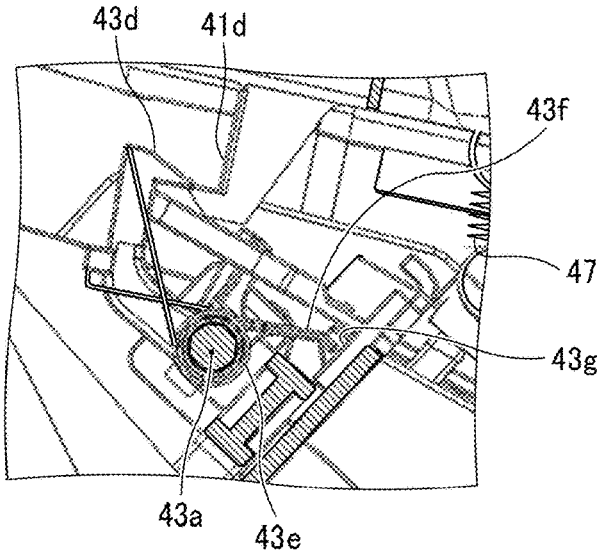
Figure 18C:
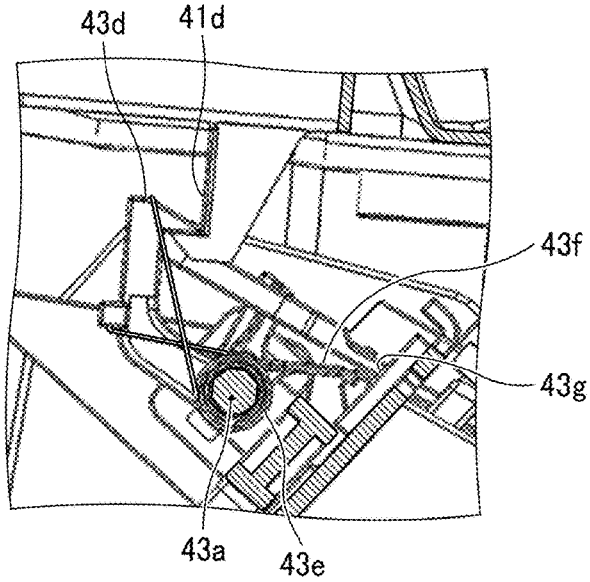

FIGS. 18A, 18B, and 18C are diagrams illustrating respective states of the tray side hook 41*d* of the upper tray unit 41 engaging with the upper limit regulator hook 43*d*.

As illustrated in FIG. 17, the upper limit regulator hook 43*d* according to the present embodiment is biased by the torsion spring 43*e* about the rotary shaft 43*a*, in a direction indicated by arrow E in FIG. 17. The upper limit regulator hook 43*d* is integrally provided with a contact member 43*f* that functions as a movement regulator. When the tray side hook 41*d* is not engaged with the upper limit regulator hook 43*d*, the contact member 43*f* contacts a contact target portion 43*g* of the tray securing unit 43, as illustrated in FIG. 18A, so as to position the position of rotation of the upper limit regulator hook 43*d*.

When the tray angle is changed to the second angle β and the upper tray unit 41 is pressed down against the biasing force of the height adjuster spring 45, the lower face (contact portion) of the tray side hook 41*d* of the upper tray unit 41 contacts the upper face (contact target portion) of the upper limit regulator hook 43*d*. Then, as the upper tray unit 41 is further pressed down, the lower face of the tray side hook 41*d* slides on the upper face of the upper limit regulator hook 43*d*. According to this action, the upper limit regulator hook 43*d* rotates about the rotary shaft 43*a* in the counterclockwise direction in FIG. 18B, against the biasing force of the torsion spring 43*e*, as illustrated in FIG. 18B. When the upper limit regulator hook 43*d* rotates until the lower face of the tray side hook 41*d* slides outside the upper face (contact target portion) of the upper limit regulator hook 43*d*, the upper limit regulator hook 43*d* rotates about the rotary shaft 43*a* in the clockwise direction in FIG. 18B, due to the biasing force of the torsion spring 43*e*. According to this action, the tray side hook 41*d* engages with the upper limit regulator hook 43*d*, so that the upper limit position of the upper tray unit 41 is regulated, as illustrated in FIG. 18C.

As a result, in a case in which the tray angle is changed to the second angle β, as the upper tray unit 41 is pressed down against the biasing force of the height adjuster spring 45, the tray side hook 41*d* engages with the upper limit regulator hook 43*d*. Accordingly, as illustrated in FIG. 12, the height of the upstream portion of the upper tray unit 41 in the initial state is substantially equal to the height when the tray angle is the first angle α (see FIG. 5).

By providing the regulator as described above, the height of the upstream portion of the upper tray unit 41 in the initial state (sheet unloaded state) is substantially equal between the first angle α and the second angle β. However, the amount of compression of the height adjuster spring 45 in the initial state (sheet unloaded state) is greater with the tray angle of the second angle β than with the tray angle of the first angle α. Therefore, the biasing force of the height adjuster spring 45 to the upper tray unit 41 is greater with the tray angle of the second angle β than with the tray angle of the first angle α. For this reason, after the sheets are stacked on the upper tray unit 41, the upper tray unit 41 at the first angle α lowers appropriately according to the amount of sheets stacked on the upper tray unit 41 to keep the height of the surface of the uppermost sheet within an appropriate range. By contrast, the upper tray unit 41 at the second angle β does not move down appropriately according to the amount of sheets stacked on the upper tray unit 41, and therefore the height of the surface of the uppermost sheet is not kept within the appropriate range.

In order to address this inconvenience, the biasing force change reducer according to the present embodiment further includes a biasing force adjuster spring 47 that functions as a different biasing member (in other words, another biasing force applier) different from the height adjuster spring 45. The biasing force adjuster spring 47 biases the upper tray unit 41 downward when the tray angle is the second angle β. In other words, the biasing force adjuster spring 47 applies a biasing force different from the height adjuster spring 45, to bias the upper tray unit 41, before and after the change of the angle of the upper tray unit 41 by the slider 44, to restrain the change of the biasing force acting on the upper tray unit 41.

Figure 19:
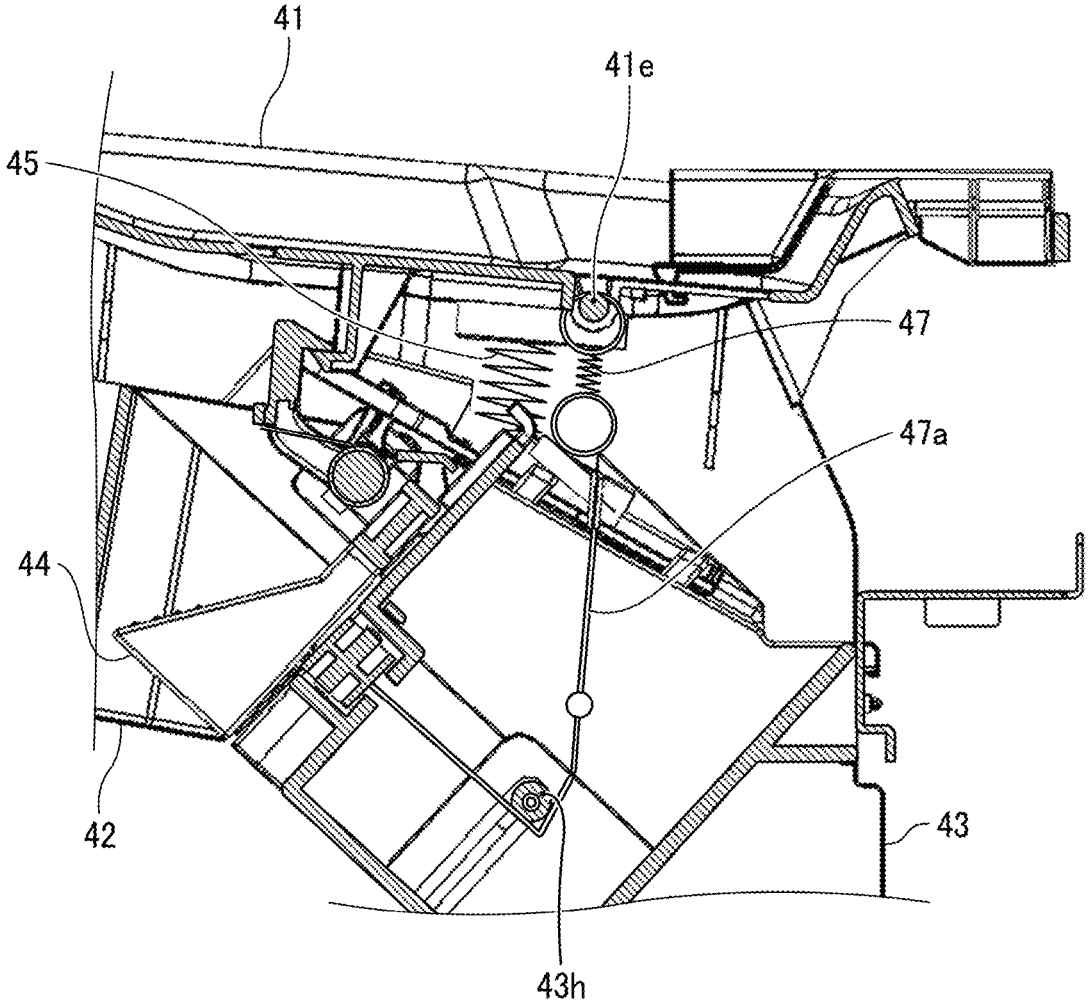
FIG. 19 is a side view illustrating a biasing force adjuster spring disposed inside the sheet ejection tray.

FIG. 19 is a side view illustrating the biasing force adjuster spring 47 that is disposed inside the sheet ejection device 4.

As illustrated in FIG. 19, the biasing force adjuster spring 47 is a tension spring having the upper end attached to a spring attaching portion 41*e* of the upper tray unit 41 and the lower end attached to a wire 47*a* that functions as a biasing member. The wire 47*a* is wound around a pulley 43*h* that is provided in the tray securing unit 43. The wire 47*a* has one end attached to the lower end of the biasing force adjuster spring 47 and the opposite end attached to a spring attaching portion 44*e* of the slider 44, as illustrated in FIGS. 14A and 14B.

In the present embodiment, when the slider 44 is at the first position (the first angle α), the wire 47*a* attached to the spring attaching portion 44*e* on the slider 44 goes slack, in other words, maintains a loosened state. Therefore, when the tray angle is the first angle α, the biasing fore of the biasing force adjuster spring 47 does not act on the upper tray unit 41. As a result, the biasing force of the height adjuster spring 45 alone acts on the upper tray unit 41.

On the other hand, when the slider 44 slides from the first position to the second position, the wire 47*a* attached to the spring attaching portion 44*e* on the slider 44 is pulled together with the slider 44. As a result, the biasing force adjuster spring 47, which has one end attached to the spring attaching portion 41*e* of the upper tray unit 41, extends. Therefore, when the tray angle is turned to the second angle β, the biasing force of the biasing force adjuster spring 47 acts on the upper tray unit 41, so that the biasing force is applied to bias the upper tray unit 41 downward. As a result, when the tray angle is the second angle β, part of the biasing force of the height adjuster spring 45 to bias the upper tray unit 41 upward is canceled (offset) by the biasing force of the biasing force adjuster spring 47 to bias the upper tray unit 41 downwardly. Accordingly, the biasing force to bias the upper tray unit 41 upward is weakened (reduced) when compared with the case in which the biasing force of the height adjuster spring 45 alone is applied to the upper tray unit 41.

In the present embodiment, the characteristics of the biasing force adjuster spring 47 and the pulling amount of the wire 47*a* are appropriately determined to adjust the biasing force, so as to apply the appropriate amount of the biasing force to the upper tray unit 41 when the tray angle is the second angle β. As a result, even at the second angle β, the upper tray unit 41 lowers appropriately according to the sheet stacking amount, and therefore the height of the surface of the uppermost sheet is maintained within an appropriate range.

Note that, in the present embodiment, the biasing force of the biasing force adjuster spring 47 to the upper tray unit 41 is switched (changed) together with movement of the slider 44. That is, the position of the biasing force adjuster spring 47 changes along with movement of the slider 44. In other words, the biasing force adjuster spring 47 switches whether or not said another biasing member applies the biasing force to the upper tray unit 41, before and after the change of the angle of the upper tray unit 41 by the slider 44, to restrain the change of the biasing force acting on the upper tray unit 41. However, the configuration is not limited to the above-described configuration. For example, the biasing force of the biasing force adjuster spring 47 to the upper tray unit 41 may be switched (changed) together with movement of a different member or another member (such as the spring receiver 46 and the upper tray unit 41) or may be switched (changed) manually.

Further, in the present embodiment, when the slider 44 is at the first position (the first angle α), the biasing force of the biasing force adjuster spring 47 does not act on the upper tray unit 41. However, as an alternative configuration, the biasing force of the biasing force adjuster spring 47 may act on the upper tray unit 41 even when the slider 44 is at the first position (the first angle α).

In the present embodiment, when the tray angle is changed from the second angle β to the first angle α, the following operations are performed.

When the tray angle is the second angle β, the tray receiving portion 44*a* of the slider 44 located on the second position is fit in the storage recess 42*a* of the lower tray unit 42, which prevents the slider 44 from sliding to the first position. Therefore, when the tray angle is changed from the second angle β to the first angle α, a user lifts the lower tray unit 42. Accordingly, the tray receiving portion 44*a* of the slider 44 comes out of the storage recess 42*a* of the lower tray unit 42, which allows the slider 44 to slide to the first position.

Here, the user may pinch the handle 44*d* of the slider 44 to slide the slider 44 in the Y direction, toward the rear side of the sheet ejection device 4 (to the first position). However, in the present embodiment, the slider 44 slides to the first position due to the biasing force of a compression spring 44*f* that functions as a slider biasing member, in order to enhance the convenience for users. Specifically, the compression spring 44*f* is mounted on the rotary shaft 43*a* to bias the slider 44 along the axial direction (the Y direction) of the rotary shaft 43*a*, to the rear side of the sheet ejection device 4 (to the first position).

When changing the tray angle from the first angle α to the second angle β, the user pinches the handle 44*d* of the slider 44 to slide the slider 44 to the front side of the sheet ejection device 4, against the biasing force of the compression spring 44*f*. Accordingly, the slider 44 moves to the second position, so that the tray receiving portion 44*a* of the slider 44 fits into the storage recess 42*a* of the lower tray unit 42. Therefore, the upper tray unit 41 rotates about the rotary shaft 43*a* via the lower tray unit 42, and therefore the tray angle comes to the second angle β. At this time, the biasing force to the rear side of the sheet ejection device 4 (in other words, the biasing force to the first position) acts on the slider 44 due to the biasing force of the compression spring 44*f*. However, since the tray receiving portion 44*a* of the slider 44 contacts the inner wall of the storage recess 42*a* of the lower tray unit 42 to regulate movement of the slider 44 to the rear side of the sheet ejection device 4, the slider 44 is positioned to the second position.

On the other hand, when the tray angle is changed from the second angle β to the first angle α, the user lifts the lower tray unit 42. As a result, the tray receiving portion 44*a* of the slider 44 comes out of the storage recess 42*a* of the lower tray unit 42, so that the slider 44 is free to move to the rear side of the sheet ejection device 4. Therefore, the slider 44 slides to the rear side of the sheet ejection device 4 due to the biasing force of the compression spring 44*f* to move to the first position.

According to this configuration, when the tray angle is changed to the first angle α to the second angle β, the user performs only a simple operation in which the user pinches the handle 44*d* of the slider 44 to slide the slider 44 to the front side of the sheet ejection device 4, against the biasing force of the compression spring 44*f*. In other words, with the operation in which the slider 44 slides toward the front side of the sheet ejection device 4, the lower tray unit 42 rotates about the rotary shaft 43*a* by the own weight to change the tray angle to the second angle β. Further, by performing the operation to slide the slider 44 toward the front side of the sheet ejection device 4, the wire 47*a* is pulled to cause the biasing force of the biasing force adjuster spring 47 to act on the upper tray unit 41. According to this operation, the part of the biasing force of the height adjuster spring 45 to bias the upper tray unit 41 upward is canceled (offset) by the biasing force of the biasing force adjuster spring 47 to bias the upper tray unit 41 downwardly. Then, the user performs a simple operation to press down the upper tray unit 41 to engage the tray side hook 41*d* of the upper tray unit 41 with the upper limit regulator hook 43*d* of the tray securing unit 43, so that the height of the upstream portion of the upper tray unit 41 comes to the target height.

In addition, when the tray angle is changed to the second angle β to the first angle α, the user performs only a simple operation in which the user lifts the lower tray unit 42. That is, by simply lifting the lower tray unit 42, the slider 44 automatically returns to the first position due to the biasing force of the compression spring 44*f* and the wire 47*a* is loosened along with the sliding movement of the slider 44, in other words, along with angle setting movement of the slider 44. Accordingly, the biasing force of the biasing force adjuster spring 47 does not act on the upper tray unit 41. Further, as the user lifts the lower tray unit 42, the upper tray unit 41 rotates about the rotary shaft 43*a*. As a result, the tray side hook 41*d* of the upper tray unit 41 comes off from the upper limit regulator hook 43*d* of the tray securing unit 43 to release the engagement, so that the upstream portion of the upper tray unit 41 comes to the target height.

Here, when the user lifts the lower tray unit 42, the tray receiving portion 44*a* of the slider 44 contacts the inner wall of the storage recess 42*a* of the lower tray unit 42 due to the biasing force of the compression spring 44*f*. Therefore, the slider 44 slightly rotates about the rotary shaft 43*a* following the movement of the lower tray unit 42. The above-described rotation is made due to a given gap (backlash) that needs to be provided between the sliding face 44*a*1 and the sliding target face 43*c* so that the slider 44 slides on the rotary shaft 43*a* while the sliding face 44*a*1 of the slider 44 attached to the rotary shaft 43*a* slides on the sliding target face 43*c* of the tray securing unit 43.

In order to restrain rotation of the slider 44 along with the movement of the lower tray unit 42, for example, a configuration in which the gap (backlash) between the sliding face 44*a*1 and the sliding target face 43*c* is filled when the slider 44 is at the second position may be applied. As a specific example, a projection is provided on the sliding face 44*a*1, of the plurality of sliding faces 44*a*1 of the slider 44, that approaches the sliding target face 43*c* when the slider 44 is rotated with rotation of the rotary shaft 43*a* or on the sliding target face 43*c*, of the plurality of sliding target faces 43*c* of the tray securing unit 43, that faces the sliding face 44*a*1 when the slider 44 is at the second position. With the contact of the projection, the slider 44 is restrained or prevented from rotating together with the rotary shaft 43*a*.

As illustrated in FIG. 10B, a stopper projection 44*a*3 is provided on the tray receiving portion 44*a* of the slider 44. When the contact face 42*c* of the lower tray unit 42 contacts the contact target face 44*a*2 of the slider 44, the stopper projection 44*a*3 fits into a stopper recess 42*d* (see FIG. 11) that is formed in a corresponding portion of the lower tray unit 42. With this configuration, when the contact face 42*c* of the lower tray unit 42 is in contact with the contact target face 44*a*2 of the slider 44 (in other words, when the tray angle is the first angle α), the slider 44 is regulated from sliding toward the front side of the sheet ejection device 4 (the second position). Accordingly, this configuration prevents the slider 44 from unintentionally sliding toward the front side of the sheet ejection device 4 (the second position), and therefore avoids the upper tray unit 41 and the lower tray unit 42 from dropping (lowering) suddenly.

Note that the stopper projection 44*a*3 has a sloped end face 44*a*4 on the rear side of the sheet ejection device 4, as illustrated in FIG. 10B, and therefore, when the slider 44 slides to the rear side of the sheet ejection device 4 (the first side) due to the biasing force of the compression spring 44*f*, the end portion of the stopper projection 44*a*3 on the rear side of the sheet ejection device 4 is prevented from being caught by the wall face of the lower tray unit 42.

Further, when the upper tray unit 41 and the lower tray unit 42 are heavy, in order to change the tray angle from the first angle α to the second angle β, it is likely that the lower tray unit 42 abruptly rotates when the tray receiving portion 44*a* of the slider 44 enters the storage recess 42*a* of the lower tray unit 42. In such a case, for example, a biasing member such as a torsion spring to bias the lower tray unit 42 may be provided around the rotary shaft 43*a* in a direction in which the downstream side portion of the lower tray unit 42 moves upward. According to this configuration, when the tray angle is changed from the first angle α to the second angle β, the lower tray unit 42 is restrained from abruptly rotating.

Note that, in the present embodiment, the height of the upstream portion of the upper tray unit 41 at the first angle α is substantially the same as the height of the upstream portion of the upper tray unit 41 at the second angle β, in a state in which no sheet is stacked on the sheet stacking face of the upper tray unit 41 (the initial state). However, the height of the upstream portion of the upper tray unit 41 at the first angle α may be different from the height of the upstream portion of the upper tray unit 41 at the second angle β.

Figure 20:
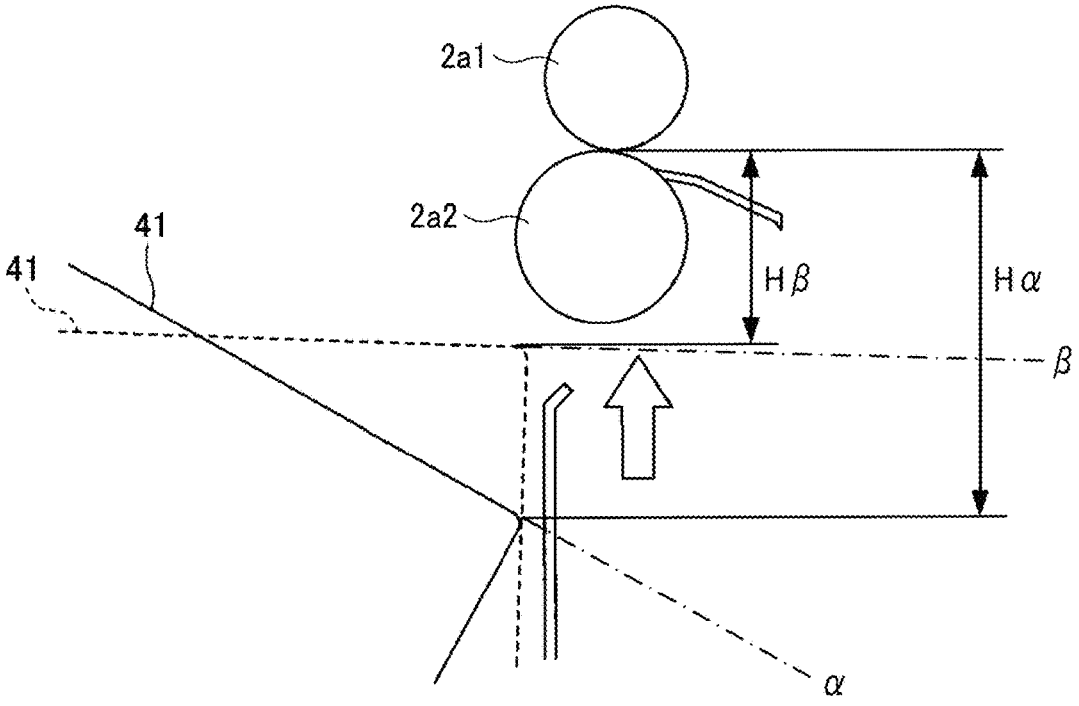
FIG. 20 is a diagram illustrating examples of different height of the upstream portion of the upper tray unit depending on the tray angle, in a state in which no sheet is stacked on the sheet stacking face of the upper tray unit (initial state)

FIG. 20 is a diagram illustrating examples of different height of the upstream portion of the upper tray unit 41 depending on the tray angle, in a state in which no sheet is stacked on the sheet stacking face of the upper tray unit 41 (initial state).

For example, in a case in which the tray angle of the upper tray unit 41 to the position of the sheet 20 to be ejected (conveyed) from the sheet ejection port 2*a* is the first angle α, a distance from the sheet ejection port 2*a* to the upstream portion of the upper tray unit 41 is a distance Hα. Similarly, in a case in which the tray angle of the upper tray unit 41 to the position of the sheet 20 to be ejected (conveyed) from the sheet ejection port 2*a* is the second angle β, a distance from the sheet ejection port 2*a* to the upstream portion of the upper tray unit 41 is a distance Hβ. As illustrated in FIG. 20, the distance Hβ of the upstream portion of the upper tray unit 41 at the second angle β (indicated with a broken line in FIG. 20) may be shorter (smaller) than the distance Hα of the upstream portion of the upper tray unit 41 at the first angle α (indicated with a solid line in FIG. 20). Since the second angle β is applied to a sheet having a relatively low stiffness such as a coated thin paper, the leading end of the sheet 20 to be ejected (conveyed) from the sheet ejection port 2*a* easily bends downward due to the own weight. Therefore, making the distance Hβ of the upstream portion of the upper tray unit 41 from the sheet ejection port 2*a* relatively short (small) in a case in which the tray angle of the upper tray unit 41 is the second angle β reduces a downward bending of the leading end of the sheet 20 that is likely to generate when a sheet having a relatively low stiffness is conveyed, and therefore prevents a failure, for example, the sheet 20 curls in a roll shape.

In addition, in the present embodiment, as illustrated in FIG. 19, the wire 47*a* is in a loose state when the tray angle of the upper tray unit 41 is the first angle α while the wire 47*a* is in a tensioned state when the tray angle of the upper tray unit 41 is the second angle β. Conversely, the wire 47*a* may be in the tensioned state when the tray angle of the upper tray unit 41 is the first angle α and the wire 47*a* may be in a loose state when the tray angle of the upper tray unit 41 is the second angle β. In this case, when the tray angle of the upper tray unit 41 is the first angle α, the biasing force of the biasing force adjuster spring 47 acts on the upper tray unit 41. Due to this action, a part of the biasing force of the height adjuster spring 45 to bias the upper tray unit 41 upward is canceled by the biasing force of the biasing force adjuster spring 47, resulting in a reduction of the biasing force that biases the upper tray unit 41 upward. By contrast, when the tray angle of the upper tray unit 41 is the second angle β, the biasing force of the biasing force adjuster spring 47 does not act on the upper tray unit 41. Consequently, the biasing force of the height adjuster spring 45 alone acts on the upper tray unit 41, and therefore the biasing force that biases the upper tray unit 41 upward increases more than the biasing force when the upper tray unit 41 is at the first angle α.

Figure 21:
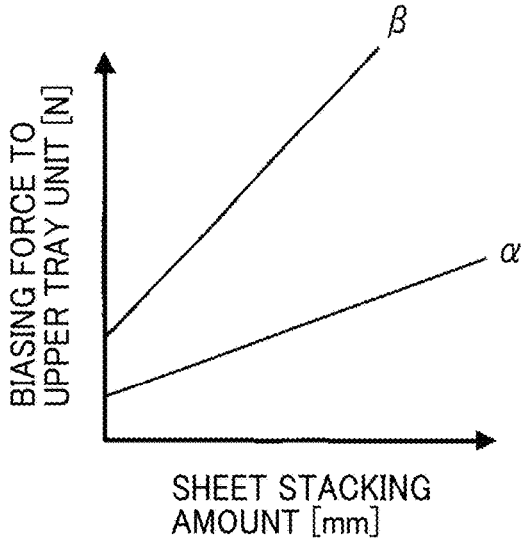
FIG. 21 is a graph of a relation of the biasing force in an upward direction acting on the upper tray unit and the sheet stacking amount of sheets (height of stacking of sheets) on the upper tray unit.

FIG. 21 is a graph of a relation of the biasing force in the upward direction acting on the upper tray unit 41 and the sheet stacking amount of sheets (the height of stacking of sheets) on the upper tray unit 41.

As described in Table 1 below, a plain paper is set as a type of sheet used when the tray angle is set to the first angle α and a coated thin paper is set as a type of sheet used when the tray angle is set to the second angle β.

TABLE 1

| Sheet Type | Tray Angle | Weight Per Sheet | Sheet Thickness | Spring Constant |
|---|---|---|---|---|
| Plain Paper | α | Light | Thick | Low |
| Coated Thin Paper | β | Heavy | Thin | High |

As described in Table 1, the coated thin paper is greater in weight per sheet and smaller in thickness when compared with the plain paper. Therefore, the coated thin paper is greater than the plain paper, in force to press down the upper tray unit 41 due to the sheet weight per sheet. Regardless of this fact, however, even if the distance in which the upper tray unit 41 lowers per thin paper is not shorter (smaller) than the distance in which the upper tray unit 41 lowers per plain paper, the height of the surface of the uppermost sheet of the sheets loaded on the upper tray unit 41 cannot be maintained at the substantially equal height, regardless of the sheet stacking amount on the upper tray unit 41. Therefore, the biasing force that biases the upper tray unit 41 upward preferably has a spring constant greater (higher) when the tray angle of the upper tray unit 41 is at the second angle β, than the spring constant when the tray angle of the upper tray unit 41 is at the first angle α.

In order to address this inconvenience, the wire 47*a* is set to a tensioned state when the tray angle is at the first angle α and the wire 47*a* is set to a loose state when the tray angle is at the second angle β, as the configuration described above. Therefore, as illustrated in the graph of FIG. 21, when the tray angle is at the second angle β, the biasing force having a higher spring constant acts on the upper tray unit 41, than when the tray angle is at the first angle α. Accordingly, regardless of the sheet stacking amount on the upper tray unit 41, the height of the surface of the uppermost sheet of the sheets loaded on the upper tray unit 41 is maintained at the substantially equal height even when a coated thin paper is used (even when the tray angle is at the second angle β).

Figure 22B:
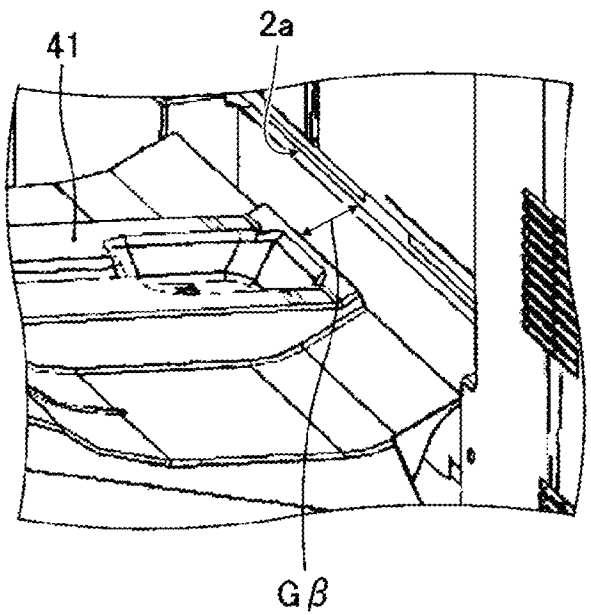
FIG. 22B is a diagram illustrating a gap between the sheet ejection port and the upstream end portion of the upper tray unit when the tray angle is a second angle β.
Figure 22A:
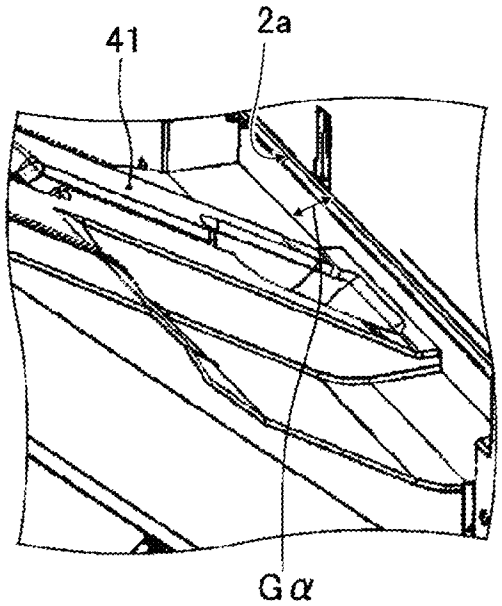
FIG. 22A is a diagram illustrating a gap between a sheet ejection port and the upstream end portion of the upper tray unit when the tray angle is a first angle α.

FIG. 22A is a diagram illustrating a gap between the sheet ejection port 2*a* and the upstream end portion of the upper tray unit 41 when the tray angle is the first angle α. FIG. 22B is a diagram illustrating a gap between the sheet ejection port 2*a* and the upstream end portion of the upper tray unit 41 when the tray angle is the second angle β.

Figure 23:
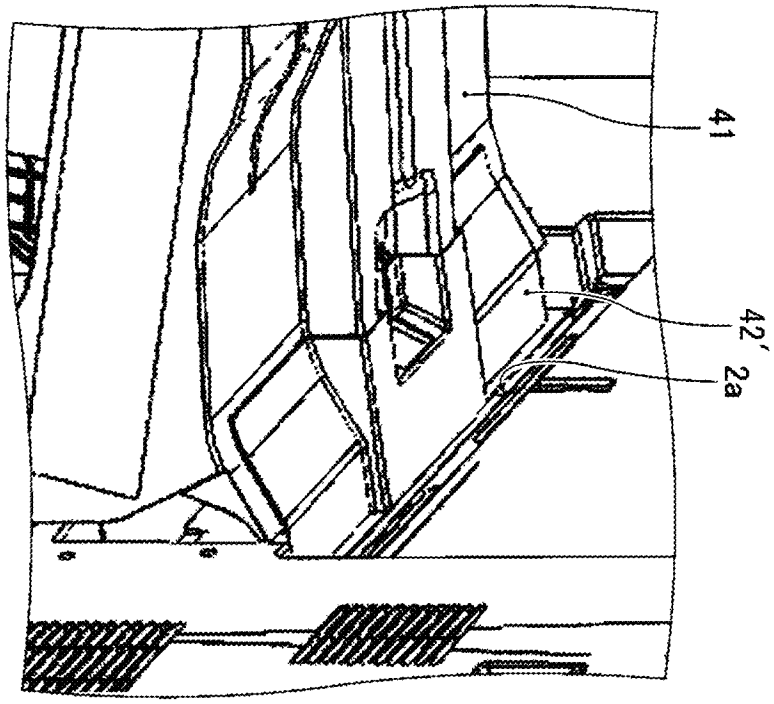
FIG. 23 is a diagram illustrating a state in which an assist tray to fill in the gap between the sheet ejection port and the upstream end portion of the upper tray unit is attached when the tray angle is the second angle β.

FIG. 23 is a diagram illustrating a state in which an assist tray 41' to fill in the gap between the sheet ejection port 2*a* and the upstream end portion of the upper tray unit 41 is attached when the tray angle is the second angle β.

Figure 24:
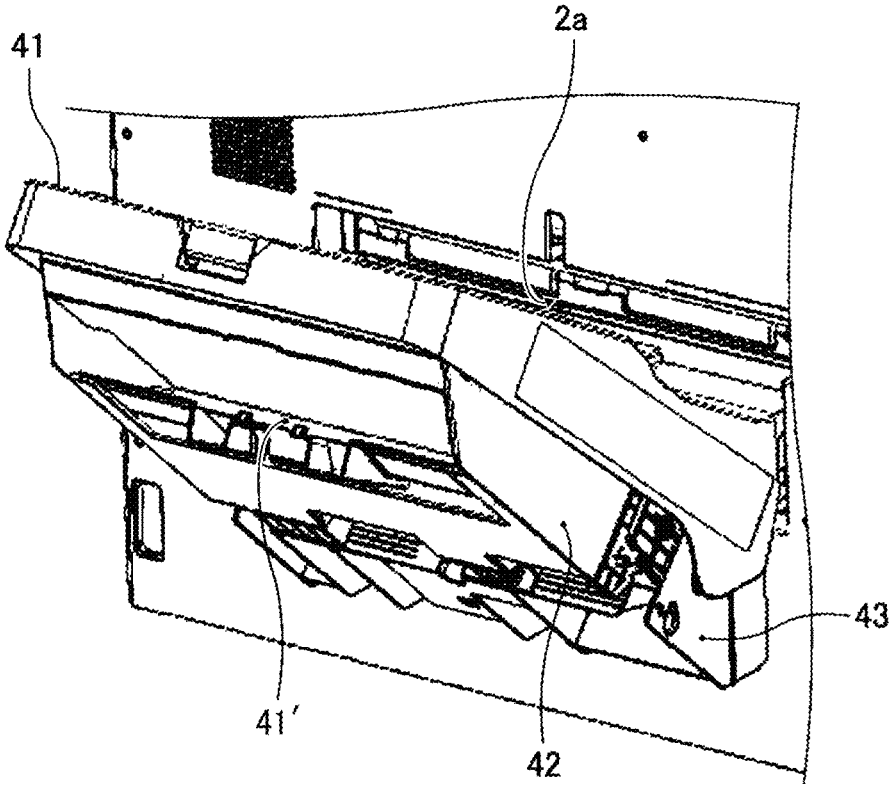
FIG. 24 is a diagram illustrating a state in which the assist tray is accommodated in an assist tray container disposed on the bottom face of a lower tray unit.

FIG. 24 is a diagram illustrating a state in which the assist tray 41' is accommodated in an assist tray container disposed on the bottom face of the lower tray unit 42.

Further, in the present embodiment, as described above, as the lower tray unit 42 rotates about the rotary shaft 43*a* of the tray securing unit 43, the upper tray unit 41 that is supported by the lower tray unit 42 also rotates about the rotary shaft 43*a* of the tray securing unit 43. Accordingly, the tray angle of the upper tray unit 41 is changed At this time, when the tray angle is the first angle α, a gap Gα between the sheet ejection port 2*a* and the upstream end portion of the upper tray unit 41 is relatively narrow, as illustrated in FIG. 22A. Therefore, even if the leading end of the sheet 20 to be ejected from the sheet ejection port 2*a* bends downward due to the own weight, the leading end of the sheet 20 does not enter the gap Gα.

However, when the tray angle is switched to the second angle β, as the upper tray unit 41 rotates about the rotary shaft 43*a*, as illustrated in FIG. 22B, the gap between the sheet ejection port 2*a* and the upstream end portion of the upper tray unit 41 increases to a gap Gβ, as illustrated in FIG. 22B. Consequently, since the leading end of the sheet 20 to be ejected from the sheet ejection port 2*a* bends downward by the own weight, the leading end of the sheet 20 enters the gap Gβ, and therefore it is likely that the sheet 20 is not stacked on the upper tray unit 41 properly. In particular, when the tray angle is set to the second angle β, a sheet having a relatively low stiffness such as a coated thin paper is often used. Therefore, the leading end of the sheet easily hangs down to easily enter the gap Gβ, which may result in a serious problem.

In such a case, for example, as illustrated in FIG. 23, when setting the tray angle to the second angle β, the assist tray 41' may be attached to the sheet ejection tray, i.e., the sheet ejection device 4, to close (cover) the gap Gβ. By closing the gap GP with the assist tray 41', even when a sheet having a low stiffness is used with the setting of the tray angle to the second angle β, the leading end of the sheet having a low stiffness is prevented from entering the gap Gβ, thereby stacking the sheet on the upper tray unit 41 properly.

Note that the assist tray 41' is to be removed when the tray angle is set to the first angle α. The assist tray 41' removed from the sheet ejection tray (i.e., the sheet ejection device 4) may be, for example, stored in an assist tray container disposed on the bottom face of the lower tray unit 42, as illustrated in FIG. 24.

Variation.

Next, a description is given of a modified example of the upper limit regulator hook and the tray side hook included in a regulator, according to Variation of the present embodiment.

Figure 25:
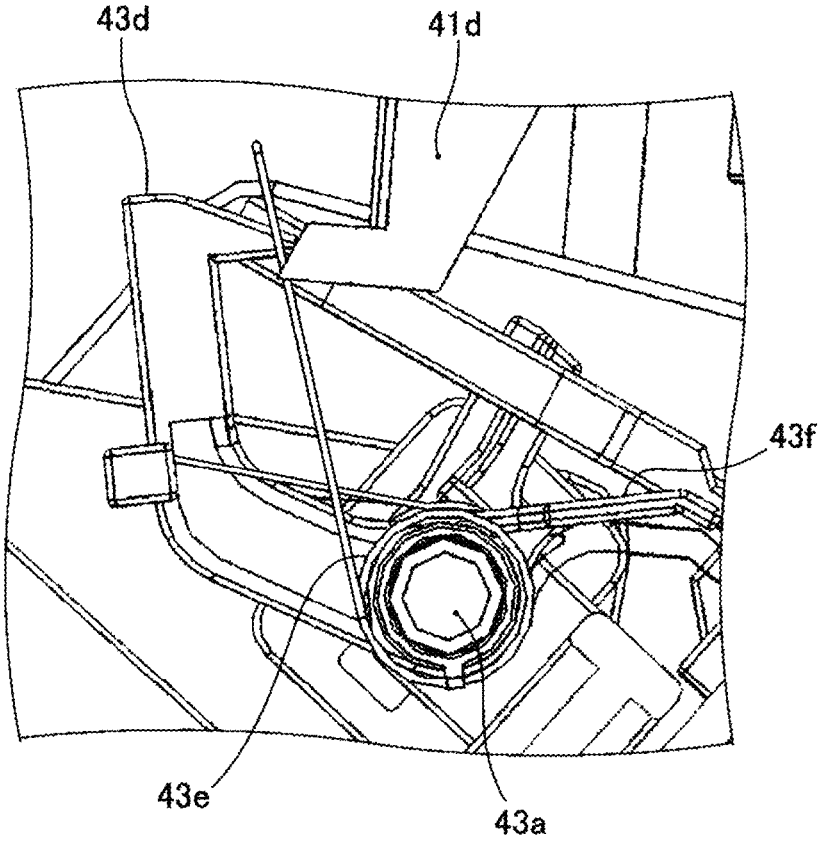
FIG. 25 is a diagram illustrating a state in which a tray side hook does not lower to a position at which the tray side hook engages with the upper limit regulator hook with rotation of the lower tray unit about a rotary shaft.

FIG. 25 is a diagram illustrating a state in which the tray side hook 41*d* does not lower to a position at which the tray side hook 41*d* engages with the upper limit regulator hook 43*d* with rotation of the lower tray unit 42 about the rotary shaft 43*a*.

In the above-described embodiment, when the tray angle is changed from the first angle α to the second angle β, the slider 44 is slid to cause the lower tray unit 42 to rotate until the contact face 42*c* of the lower tray unit 42 comes into contact with the sliding target face 43*c* of the tray securing unit 43. At this time, the upper tray unit 41 rotates together with the lower tray unit 42, so that the tray side hook 41*d* of the upper tray unit 41 engages with the upper limit regulator hook 43*d* on the rotary shaft 43*a* of the tray securing unit 43. By so doing, the tray angle is switched to the second angle β.

However, in the above-described embodiment, simply sliding the slider 44 to cause the lower tray unit 42 to rotate about the rotary shaft 43*a* is not likely to lower the tray side hook 41*d* to the position at which the tray side hook 41*d* engages with the upper limit regulator hook 43*d*, as illustrated in FIG. 25. In particular, in a case in which the biasing force illustrated in FIG. 21 is obtained, in other words, in a case in which the biasing force to bias the upper tray unit 41 upward with the upper tray unit 41 at the second angle β is greater in the spring constant than the biasing force to bias the upper tray unit 41 upward with the upper tray unit 41 at the first angle α, the biasing force applied by the biasing force adjuster spring 47 to bias the upper tray unit 41 downward is canceled. As a result, the tray side hook 41*d* does not lower to the position at which the tray side hook 41*d* engages with the upper limit regulator hook 43*d* easily.

If the tray side hook 41*d* does not lower to the position at which the tray side hook 41*d* engages with the upper limit regulator hook 43*d*, the upper tray unit 41 is pressed down by a user against the biasing force of the height adjuster spring 45 to cause the tray side hook 41*d* to engage with the upper limit regulator hook 43*d*. As a result, the workload of a user in switching the tray angle from the first angle α to the second angle β increases, thereby degrading the convenience of the image forming apparatus 1.

In order to address this inconvenience, Variation provides a configuration in which, by simply sliding the slider 44 to cause the lower tray unit 42 to rotate about the rotary shaft 43*a*, the tray side hook 41*d* engages with the upper limit regulator hook 43*d*. To be more specific, in Variation, an upper limit regulator hook 43*i* and a tray side hook 41*f* employed to this Variation, instead of the upper limit regulator hook 43*d* and the tray side hook 41*d* in the above-described embodiment. In other words, the shape of the contact portion of the tray side hook 41*f* is different from the shape of the contact portion of the tray side hook 41*d* and the shape of the contact target portion of the upper limit regulator hook 43*i* is different from the shape of the contact target portion of the upper limit regulator hook 43*d*.

Figure 26:
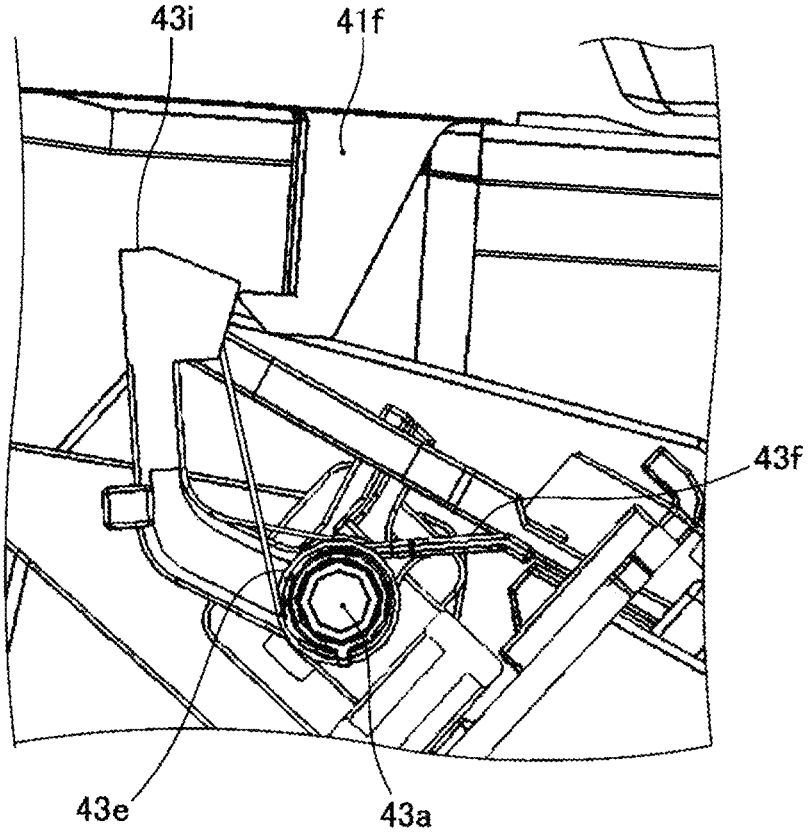
FIG. 26 is a diagram illustrating the configuration of an upper limit regulator hook and a tray side hook in variation of the present embodiment.

FIG. 26 is a diagram illustrating the configuration of the upper limit regulator hook 43*i* and the tray side hook 41*f* in Variation.

FIGS. 27A, 27B, 27C, and 27D are diagrams illustrating sequential states in which the tray side hook 41*f* of the upper tray unit 41 engages with the upper limit regulator hook 43*i* when switching the tray angle from the first angle α to the second angle β in Variation illustrated in FIG. 26.

Figure 28:
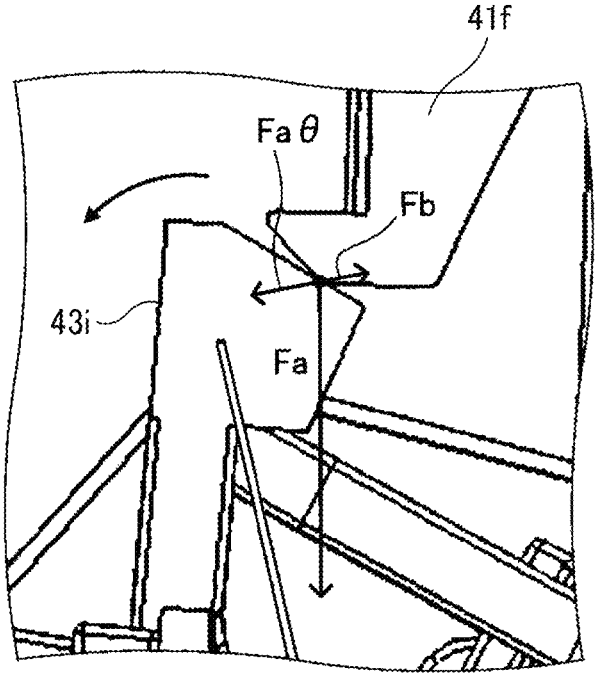
FIG. 28 is a diagram illustrating a contact force when the lower end of the tray side hook contacts an upper sloped face of the upper limit regulator hook.

FIG. 28 is a diagram illustrating a contact force when the lower end of the tray side hook 41*f* contacts an upper sloped face 43*i*1 of the upper limit regulator hook 43*i*.

Figure 29:
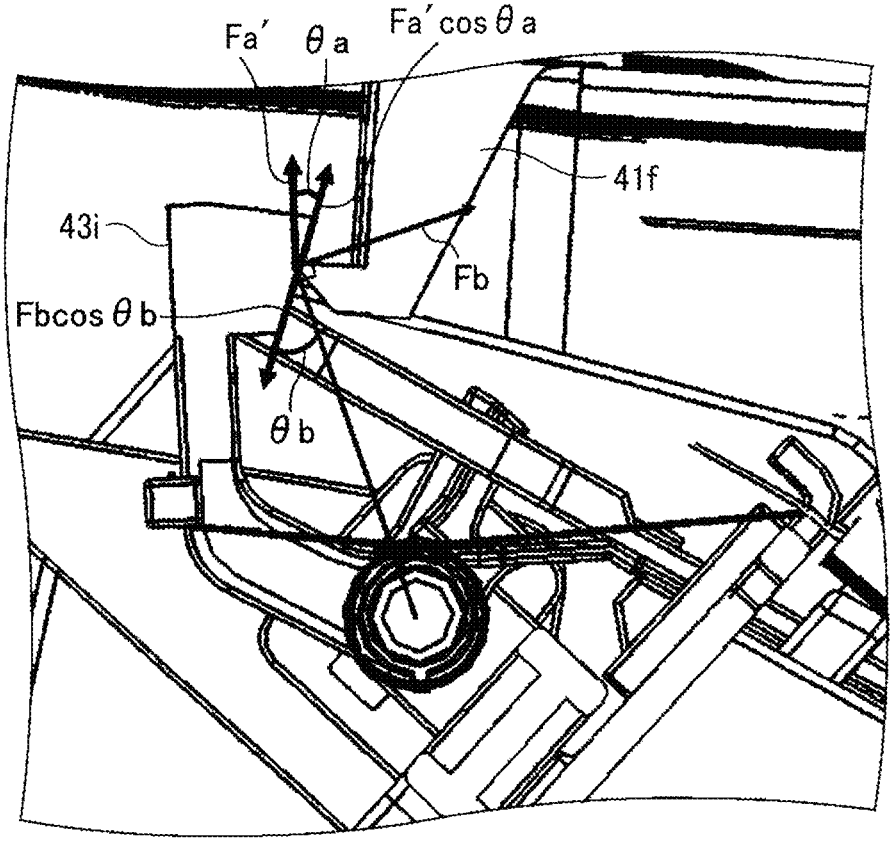
FIG. 29 is a diagram illustrating a contact force when the leading end of the tray side hook contacts a lateral sloped face of the upper limit regulator hook.

FIG. 29 is a diagram illustrating a contact force when the leading end of the tray side hook 41*f* contacts a lateral sloped face 43*i*3 of the upper limit regulator hook 43*i*.

Figure 27B:
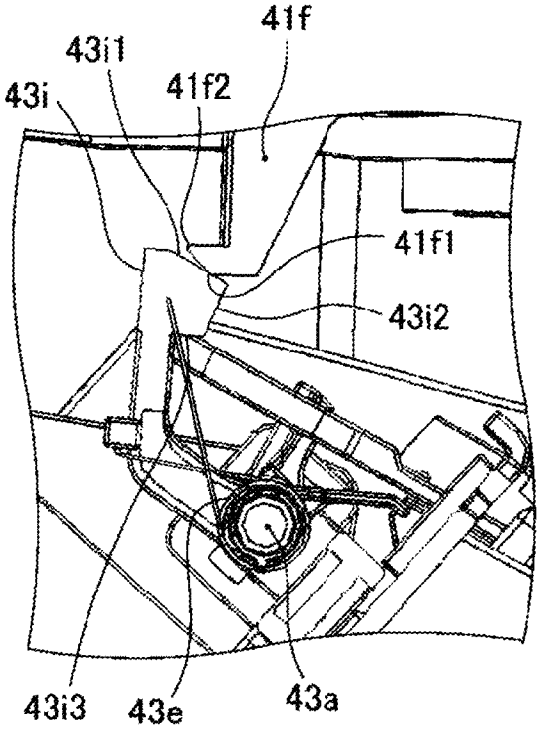
FIGS. 27A, 27B, 27C, and 27D are diagrams illustrating sequential states in which the tray side hook of the upper tray unit engages with the upper limit regulator hook when switching the tray angle from the first angle α to the second angle β in variation of FIG. 26.
Figure 27A:
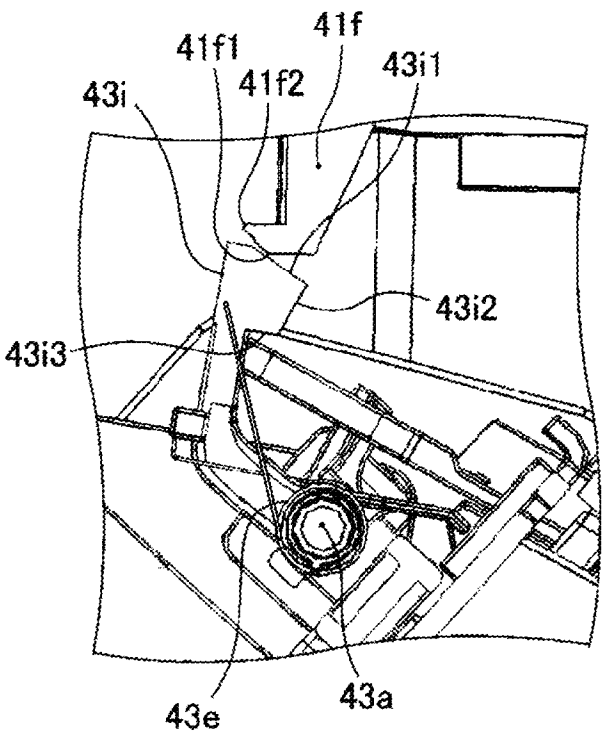

In Variation, when the tray angle is switched from the first angle α to the second angle β, the slider 44 slides to cause the lower tray unit 42 to rotate about the rotary shaft 43*a*. Accordingly, the upper tray unit 41 rotates together with the lower tray unit 42, and the tray side hook 41*f* of the upper tray unit 41 comes down along with the rotation of the upper tray unit 41. Thereafter, in the variation, a lower end 41*f*1 that functions as a contact portion of the tray side hook 41*f* of the upper tray unit 41 contacts an upper sloped face 43*i*1 that functions as a contact target portion of the upper limit regulator hook 43*i* in the middle of rotation of the lower tray unit 42, as illustrated in FIG. 27A.

At this time, the upper sloped face 43*i*1 of the upper limit regulator hook 43*i* receives a contact force Fa from the lower end 41*f*1 of the tray side hook 41*f*, as illustrated in FIG. 28. The contact force Fa is a force obtained mainly by subtracting the biasing force of the height adjuster spring 45 from the own weight of the upper tray unit 41 (in the configuration to obtain the biasing force illustrated in FIG. 21, the biasing force of the biasing force adjuster spring 47 is added to the own weight of the upper tray unit 41).

In Variation, the upper sloped face 43*i*1 of the upper limit regulator hook 43*i* is inclined to the orientation of the contact force Fa received from the lower end 41*f*1 of the tray side hook 41*f*. Therefore, as illustrated in FIG. 28, a rotational force Faθ acts on the upper sloped face 43*i*1 of the upper limit regulator hook 43*i*, where the rotational force Faθ is a force to rotate in the counterclockwise direction in FIG. 27 about the rotary shaft 43*a* against a biasing force Fb of the torsion spring 43*e*. In the variation, the inclination of the upper sloped face 43*i*1 of the upper limit regulator hook 43*i* is set so that the rotational force Faθ is significantly greater than the biasing force Fb of the torsion spring 43*e*. According to this configuration, as illustrated in FIG. 27B, while the lower end 41*f*1 of the tray side hook 41*f* slides on the upper sloped face 43*i*1 of the upper limit regulator hook 43*i*, the upper limit regulator hook 43*i* rotates about the rotary shaft 43*a* in the counterclockwise direction in FIG. 27B against the biasing force Fb of the torsion spring 43*e*.

Figure 27D:
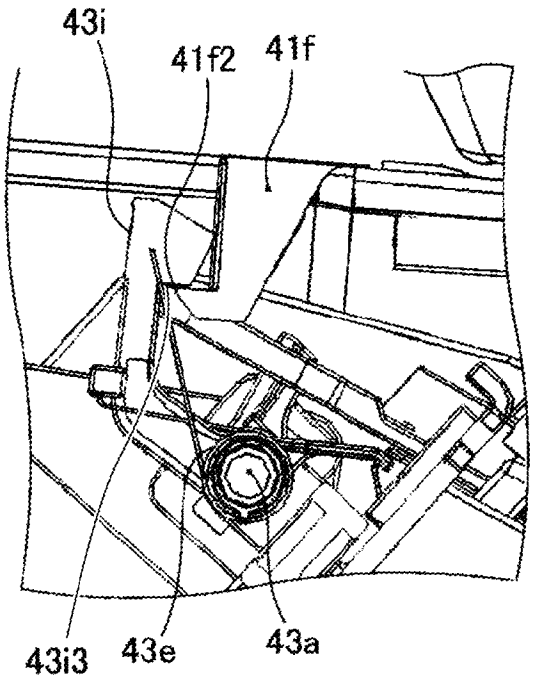
Figure 27C:
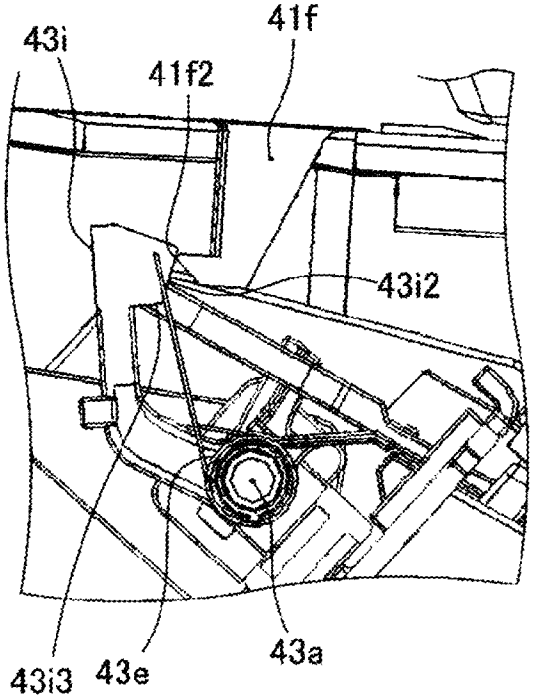

Then, after the lower end 41*f*1 of the tray side hook 41*f* has reached the end portion of the upper sloped face 43*i*1 of the upper limit regulator hook 43*i*, a leading end 41*f*2 that functions as a contact portion of the tray side hook 41*f* of the upper tray unit 41 then comes into contact with a lateral sloped face 43*i*3 that functions as a contact target portion of the upper limit regulator hook 43*i*, as illustrated in FIG. 27C. In this variation, as illustrated in FIG. 27C, when leading end 41*f*2 of the tray side hook 41*f* has contacted the lateral sloped face 43*i*3 of the upper limit regulator hook 43*i*, the lower tray unit 42 terminates the rotation about the rotary shaft 43*a*.

At this time, since the biasing force Fb of the torsion spring 43*e* acts on the upper limit regulator hook 43*i*, the leading end 41*f*2 of the tray side hook 41*f* receives the contact force Fb (i.e., the biasing force Fb of the torsion spring 43*e*) from the lateral sloped face 43*i*3 of the upper limit regulator hook 43*i*, as illustrated in FIG. 29. Then, in this variation, the angle of inclination of the lateral sloped face 43*i*3 of the upper limit regulator hook 43*i* is adjusted so that an external force acts on leading end 41*f*2 of the tray side hook 41*f*, where the external force causes the leading end 41*f*2 of the tray side hook 41*f* to move downward along the lateral sloped face 43*i*3 of the upper limit regulator hook 43*i*.

Specifically, as illustrated in FIG. 29, the inclination angle of the lateral sloped face 43*i*3 of the upper limit regulator hook 43*i* is adjusted so that the surface directional component Fb·cos θb (i.e., force by which the upper limit generator hook 43*i* presses down the tray side hook 41*f*) of the lateral sloped face 43*i*3 in the biasing force (contact force) Fb of the torsion spring 43*e* is greater than the surface directional component Fa'·cos θa of the lateral sloped face 43*i*3 in a force Fa' to push up the leading end 41*f*2 of the tray side hook 41*f*. The force Fa' is a force obtained mainly by subtracting the own weight of the upper tray unit 41 (in the configuration to obtain the biasing force illustrated in FIG. 21, the biasing force of the biasing force adjuster spring 47 is further added to the own weight of the upper tray unit 41), from the biasing force of the height adjuster spring 45.

According to this configuration, the upper limit regulator hook 43*i* rotates in the clockwise direction in FIG. 27D about the rotary shaft 43*a* by the biasing force Fb of the torsion spring 43*e*. Therefore, while the leading end 41*f*2 of the tray side hook 41*f* slides on the lateral sloped face 43*i*3 of the upper limit regulator hook 43*i*, the tray side hook 41*f* lowers. When the leading end 41*f*2 of the tray side hook 41*f* slides and reaches the end portion of the lateral sloped face 43*i*3 of the upper limit regulator hook 43*i*, the leading end 41*f*2 of the tray side hook 41*f* is caught by a jaw portion 43*i*3 of the upper limit regulator hook 43*i* so that the tray side hook 41*f* engages with the upper limit regulator hook 43*i*, as illustrated in FIG. 27D.

As described above, according to this variation, when the tray angle is changed from the first angle α to the second angle β, as the lower tray unit 42 rotates about the rotary shaft 43*a*, the upper tray unit 41 rotates together with the lower tray unit 42. Along with the rotation of the upper tray unit 41, the lower end 41*f*1 and the leading end 41*f*2 of the tray side hook 41*f* contact the upper sloped face 43*i*1 and the lateral sloped face 43*i*3 of the upper limit regulator hook 43*i*, respectively. In response to this contact, the tray side hook 41*f* and the upper limit regulator hook 43*i* relatively move due to the contact force acting on the contact portion. As a result, the tray side hook 41*f* and the upper limit regulator hook 43*i* engage with each other, and therefore the upper tray unit 41 changes to the regulating state. Accordingly, simply sliding the slider 44 to cause the lower tray unit 42 to rotate about the rotary shaft 43*a* completes switching of the tray angle to the second angle β, thereby enhancing the convenience of the image forming apparatus 1.

The configurations according to the above-descried embodiments are not limited thereto. This disclosure can achieve the following aspects effectively.

Aspect 1.

In a sheet stacker (for example, the sheet ejection device 4) of Aspect 1 includes a sheet stacking member (for example, the upper tray unit 41), a biasing force applier (for example, the height adjuster spring 45), an angle setter (for example, the slider 44), and a regulator (for example, the tray side hook 41*d*, the tray side hook 41*f*, the upper limit regulator hook 43*d*, the upper limit regulator hook 43*i*). The sheet stacking member has an upstream portion in a sheet conveyance direction. The upstream portion of the sheet stacking member is movable in a vertical direction. The biasing force applier is configured to bias the sheet stacking member upward. The angle setter is configured to set an angle of the sheet stacking member in the sheet conveyance direction, relative to a sheet conveying portion (for example, the sheet ejection port 2*a*), between a first angle (for example, the first angle (alpha)) and a second angle (the second angle (beta)). The regulator is configured to regulate movement of the sheet stacking member in a case in which the upstream portion of the sheet stacking member is located closer to the sheet conveying portion at either the first angle or the second angle.

When the angle setter sets and changes the angle of the sheet stacking face of the sheet stacking member, the attitude (position) of the sheet stacking member may change relative to the biasing member, and therefore the biasing force to be applied from the biasing member to the sheet stacking member may change. In this case, the height of the upstream portion in the sheet conveyance direction of the sheet stacking member (in other words, the height of the portion to which the leading end of the sheet conveyed from the sheet conveying portion contacts) is displaced (shifted) from the target height, resulting in degradation of the sheet stacking performance (the sheet stackability) at the angle before and after the change of the angle.

Specifically, for example, in a case in which the height of the sheet stacking face of the upstream portion of the sheet stacking member in the sheet conveyance direction or the height of the surface of the uppermost sheet of the sheets stacked on the sheet stacking member is too low with respect to the sheet to be conveyed from the sheet conveying portion, the leading end of the sheet contacts the sheet stacking face of the upstream portion of the sheet stacking member or the surface of the uppermost sheet of the sheets on the sheet stacking member while being hanged down by the own weight of the sheet. Therefore, the trailing end of the sheet is conveyed prior to the leading end of the sheet in the sheet conveyance direction, and the sheet is curled up into a roll shape. Conversely, in a case in which he height of the sheet stacking face of the sheet stacking member or the height of the surface of the uppermost sheet is too high, the leading end of the sheet collides the end face of the sheet stacking member or an end face of the sheet bundle loaded on the sheet stacking member prior to the upstream portion in the sheet conveyance direction of the sheet stacking member. Therefore, the sheet is not conveyed appropriately to the sheet stacking face of the sheet stacking member.

In Aspect 1, of the first angle and the second angle, when the upstream portion in the sheet conveyance direction of the sheet stacking member is at an angle approaching the sheet conveying portion, the regulator regulates movement of the sheet stacking member. According to this configuration, even when the height of the upstream portion of the sheet stacking member in the sheet conveyance direction in the initial state in which no sheet is stacked or loaded due to the change of the biasing force applied to the sheet stacking member by the biasing member is displaced (shifted) more upward than the target height, the regulator regulates to restrain the displacement (shift).

Aspect 2.

In Aspect 2 according to Aspect 1, the regulator (for example, the tray side hook 41*d*, the tray side hook 41*f*, the upper limit regulator hook 43*d*, the upper limit regulator hook 43*i*) is configured to regulate movement of the sheet stacking member (for example, the upper tray unit 41) along with angle setting movement of the angle setter (for example, the slider 44).

According to Aspect 2, since the regulator regulates the movement of the sheet stacking member along with the angle setting movement of the angle setter, a user does not perform a user operation to simply switch the state of the regulator, thereby obtaining the convenience for users.

Aspect 3.

In Aspect 3 according to Aspect 1 or Aspect 2, the sheet stacker (for example, the sheet ejection device 4) further includes a securing member (for example, the tray securing unit 43) and an upper limit regulation target member (for example, the tray side hook 41*d*, 41*f*). The securing member has an upper limit regulation member (for example, the upper limit regulator hook 43*d*, 43*i*) and is configured to be attached to an image forming apparatus (for example, the image forming apparatus 1) and support the sheet stacking member. The upper limit regulation target member is mounted on the sheet stacking member. The regulator is configured to enter a regulating state in which the regulator regulates an upper height limit position of the upstream portion of the sheet stacking member, as the upper limit regulation target member contacts the upper limit regulation member when the sheet stacking member is at the second angle, and switch from the regulating state to a non-regulating state in which the regulator does not regulate the upper height limit position of the upstream portion of the sheet stacking member, as the upper limit regulation target member and the upper limit regulation member relatively move in a direction intersecting a contact direction in which the upper limit regulation target member contacts the upper limit regulation member, along with angle setting movement of the angle setter, when the sheet stacking member is changed from the second angle to the first angle.

According to this configuration, the image forming apparatus is provided with a more simplified regulator.

Aspect 4.

In Aspect 4 according to Aspect 3, the upper limit regulation target member (for example, the tray side hook 41*d*, 41*f*) is disposed at a center of the sheet stacking member (for example, the upper tray unit 41) in a sheet width direction perpendicular to the sheet conveyance direction.

In a case in which a plurality of upper limit regulation target members (for example, the tray side hook 41*d*, 41*f*) is provided in the sheet width direction of the sheet stacking member, for example, it is likely to cause a failure in which, when the whole of the plurality of upper limit regulation target members are to enter an appropriate regulating state, a part of the plurality of upper limit regulation target members fails to achieve the appropriate regulating states. Similarly, it is likely to cause a failure in which, when the whole of the plurality of upper limit regulation target members are to enter an appropriate non-regulating state, a part of the plurality of upper limit regulation target members fails to achieve the appropriate non-regulating states. Accordingly, the configuration in which a single set of the upper limit regulation target member is provided substantially at the center in the sheet width direction reduces the above-described inconveniences.

Aspect 5.

In Aspect 5 according to Aspect 3 or Aspect 4, the securing member (for example, the tray securing unit 43) includes a rotary shaft (for example, the rotary shaft 43*a*). The upper limit regulation target member (for example, the tray side hook 41*d*, 41*f*) and the upper limit regulation member (for example, the upper limit regulator hook 43*d*, 43*i*) are configured to move relatively in response to rotation of at least one of the upper limit regulation target member and the upper limit regulation member about the rotary shaft of the securing member.

According to this configuration, the image forming apparatus is provided with a more simplified regulator to perform the relative movement.

Aspect 6.

In Aspect 6 according to Aspect 5, the angle setter (for example, the slider 44) is rotatably disposed relative to the securing member (for example, the tray securing unit 43). The angle setter includes a rotary support (for example, the lower tray unit 42) configured to support the sheet stacking member (for example, the upper tray unit 41) rotatably in the vertical direction. The angle setter is configured to change a rotational angle of the rotary support to set the angle of the sheet stacking member between the first angle and the second angle. The upper limit regulation member (for example, the upper limit regulator hook 43*d*, the upper limit regulator hook 43*i*) is mounted on the rotary support. The upper limit regulation target member (for example, the tray side hook 41*d*, the tray side hook 41*f*) and the upper limit regulation member are configured to move relatively as the upper limit regulation member rotates along with rotation of the rotary support.

Accordingly, this configuration enhances the convenience for users.

Aspect 7.

In Aspect 7 according to any one of Aspects 3 to 6, the upper limit regulation target member (for example, the tray side hook 41*d*, the tray side hook 41*f*) and the upper limit regulation member (for example, the upper limit regulator hook 43*d*, the upper limit regulator hook 43*i*) are configured to move relatively in response to movement of one member of the upper limit regulation target member and the upper limit regulation member. Another member of the upper limit regulation target member and the upper limit regulation member is configured to be biased in a biasing direction opposite to a direction in which the one member moves.

According to this configuration, since the biasing force in the direction opposite to the direction in which the regulator moves relatively acts on said another member, the regulating state is stably maintained.

Aspect 8.

In Aspect 8 according to Aspect 7, the sheet stacker (for example, the sheet ejection device 4) further includes a movement regulator (for example, the contact member 43*f*) configured to regulate movement of said another member in the biasing direction.

According to this configuration, even if the biasing force is applied to said another member in a direction opposite to the direction in which the regulator (for example, the tray side hook 41*f*, the upper limit regulator hook 43*i*) relatively moves, said another member is positioned to a given position in the non-regulating state, and therefore the non-regulating state is switched to the regulating state properly.

Aspect 9.

In Aspect 9 according to Aspect 7 or Aspect 8, the upper limit regulation target member (for example, the tray side hook 41*d*, 41*f*) and the upper limit regulation member (for example, the upper limit regulator hook 43*d*, 43*i*) are configured to contact with each other. In response to contact of the upper limit regulation target member and the upper limit regulation member when the regulator (for example, the tray side hook 41*f*, the upper limit regulator hook 43*i*) is changed from the non-regulating state to the regulating state, said another member is configured to move against the biasing force of the biasing force applier (for example, the height adjuster spring 45) to change the upper limit regulation target member and the upper limit regulation member to the regulating state.

According to this configuration, the switching from the non-regulating state to the regulating state is achievable with a simple configuration.

Aspect 10.

In Aspect 10 according to any one of Aspects 3 to 9, along with a change of the angle of the sheet stacking member (for example, the upper tray unit 41) from the first angle to the second angle, a contact portion (for example, the lower end 41*f*1, the leading end 41*f*2) of one member of the upper limit regulation member (for example, the upper limit regulator hook 43*d*, 43*i*) and the upper limit regulation target member (for example, the tray side hook 41*d*, 41*f*) is configured to contact a contact target portion (for example, the upper sloped face 43*i*1, the lateral sloped face 43*i*3) of another member of the upper limit regulation member and the upper limit regulation target member. After the upper limit regulation member and the upper limit regulation target member relatively move by a contact force (for example, the contact force Fa, the contact force Fb), the contact portion of the one member is configured to engage with the contact target portion of said another member to switch the regulator (for example, the tray side hook 41*f*, the upper limit regulator hook 43*i*) from the non-regulating state to the regulating state.

According to Aspect 10, by the contact force acting on the contact portion between the upper limit regulation member and the upper limit regulation target member, generated along with the angle setting by the angle setter, the state of the sheet stacking member is switched from the non-regulating state to the regulating state.

Aspect 11.

In Aspect 11 according to Aspect 10, when the angle of the sheet stacking member (for example, the upper tray unit 41) is changed from the first angle to the second angle, the contact portion (for example, the lower end 41*f*1, the leading end 41*f*2) of the one member is configured to slide along a contact target face of the contact target portion of said another member by the contact force (for example, the contact force Fa, the contact force Fb). After the upper limit regulation target member (for example, the tray side hook 41*d*, 41*f*) and the upper limit regulation member (for example, the upper limit regulator hook 43*d*, 43*i*) relatively move and the contact portion reaches an end portion of the contact target portion (for example, the upper sloped face 43*i*1, the lateral sloped face 43*i*3), the contact portion of the one member is configured to disengage from the contact target portion of said another member to switch the regulator (for example, the tray side hook 41*f*, the upper limit regulator hook 43*i*) from the non-regulating state to the regulating state.

In Aspect 11, by the contact force acting on the contact portion between the upper limit regulation member and the upper limit regulation target member, generated along with the angle setting by the angle setter, the contact portion slides along the contact target face of the contact target portion, thereby switching the state of the sheet stacking member from the non-regulating state to the regulating state. According to this configuration, by adjusting the angle of the contact target face of the contact target portion, the upper limit regulation target member and the upper limit regulation member are relatively moved by the contact force alone, so that the state of the sheet stacking member is switched from the non-regulating state to the regulating state.

Aspect 12.

In Aspect 12 according to any one of Aspects 3 to 11, the sheet stacker (for example, the sheet ejection device 4) further includes another regulator (for example, the upstream guide projection 41*a*, the vertical guide groove 43*b*) configured to enter the regulating state when the sheet stacking member (for example, the upper tray unit 41) is at the first angle, and enter the non-regulating state when the sheet stacking member is at the second angle.

According to this configuration, said another regulator regulates the upper limit height position of the upstream portion in the sheet conveyance direction of the sheet stacking member when the angle of the sheet stacking member is the first angle (for example, the first angle $\alpha$). Moreover, when the angle is the second angle $\beta$, said another regulator enters the non-regulating state. Therefore, said another regulator does not hinder the regulating state of the regulator.

Aspect 13.

In Aspect 13 according to Aspect 12, the regulator (for example, the tray side hook 41*d*, the tray side hook 41*f*, the upper limit regulator hook 43*d*, the upper limit regulator hook 43*i*) is configured to regulate the upstream portion in the sheet conveyance direction of the sheet stacking member (for example, the upper tray unit 41) at the first angle to be an equal upper height limit position to the upper height limit position of the upstream portion in the sheet conveyance direction of the sheet stacking member at the second angle.

According to this configuration, the height of the upstream side portion of the sheet stacking member in the sheet conveyance direction in the initial state (the sheet unloaded state) is substantially equal before and after the change of the angle by the angle setter.

Aspect 14.

In Aspect 14, an image forming apparatus (for example, the image forming apparatus 1) includes an image bearer (for example, the photoconductors 12Y, 12C, 12M, and 13K) and the sheet stacker (for example, the sheet ejection device 4). The image bearer is configured to form an image on a sheet (the sheet 20). The sheet stacker (for example, the sheet ejection device 4) according to claim 1, configured to stack the sheet (for example, the sheet 20) having the image formed by the image bearer.

According to this configuration, even when the angle setter sets and changes the angle of the sheet stacking face of the sheet stacking member (for example, the upper tray unit 41), a preferable sheet stacking performance (that is, the sheet stackability) is obtained.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure, and are included in the scope of the invention recited in the claims and its equivalent.

Any one of the above-described operations may be performed in various other ways, for example, in an order different from the one described above.

What is claimed is:

1. A sheet stacker comprising:

a sheet stacking member having an upstream portion in a sheet conveyance direction, the upstream portion being movable in a vertical direction;

a biasing force applier configured to apply a biasing force to bias the sheet stacking member upward;

an angle setter configured to set an angle of the sheet stacking member in the sheet conveyance direction, relative to a sheet conveying portion, between a first angle and a second angle; and a regulator configured to regulate movement of the sheet stacking member in a case in which the upstream portion of the sheet stacking member is located closer to the sheet conveying portion at either the first angle or the second angle.

2. The sheet stacker according to claim 1, wherein the regulator is configured to regulate movement of the sheet stacking member along with angle setting movement of the angle setter.

3. The sheet stacker according to claim 1, further comprising:

a securing member having an upper limit regulation member and configured to be attached to an image forming apparatus and support the sheet stacking member; and an upper limit regulation target member mounted on the sheet stacking member, wherein the regulator is configured to:

enter a regulating state in which the regulator regulates an upper height limit position of the upstream portion of the sheet stacking member, as the upper limit regulation target member contacts the upper limit regulation member when the sheet stacking member is at the second angle; and switch from the regulating state to a non-regulating state in which the regulator does not regulate the upper height limit position of the upstream portion of the sheet stacking member, as the upper limit regulation target member and the upper limit regulation member relatively move in a direction intersecting a contact direction in which the upper limit regulation target member contacts the upper limit regulation member, along with angle setting movement of the angle setter, when the sheet stacking member is changed from the second angle to the first angle.

4. The sheet stacker according to claim 3, wherein the upper limit regulation target member is disposed at a center of the sheet stacking member in a sheet width direction perpendicular to the sheet conveyance direction.

5. The sheet stacker according to claim 3, wherein the securing member includes a rotary shaft, and wherein the upper limit regulation target member and the upper limit regulation member are configured to move relatively in response to rotation of at least one of the upper limit regulation target member and the upper limit regulation member about the rotary shaft of the securing member.

6. The sheet stacker according to claim 5, wherein the angle setter is rotatably disposed relative to the securing member, wherein the angle setter includes a rotary support configured to support the sheet stacking member rotatably in the vertical direction, wherein the angle setter is configured to change a rotational angle of the rotary support to set the angle of the sheet stacking member between the first angle and the second angle, wherein the upper limit regulation member is mounted on the rotary support, and wherein the upper limit regulation target member and the upper limit regulation member are configured to move relatively as the upper limit regulation member rotates along with rotation of the rotary support.

7. The sheet stacker according to claim 3, wherein the upper limit regulation target member and the upper limit regulation member are configured to move relatively in response to movement of one member of the upper limit regulation target member and the upper limit regulation member, and wherein another member of the upper limit regulation target member and the upper limit regulation member is configured to be biased in a biasing direction opposite to a direction in which the one member moves.

8. The sheet stacker according to claim 7, further comprising a movement regulator configured to regulate movement of said another member in the biasing direction.

9. The sheet stacker according to claim 7, wherein the upper limit regulation target member and the upper limit regulation member are configured to contact with each other, and wherein, in response to contact of the upper limit regulation target member and the upper limit regulation member when the regulator is changed from the non-regulating state to the regulating state, said another member is configured to move against the biasing force of the biasing force applier to change the upper limit regulation target member and the upper limit regulation member to the regulating state.

10. The sheet stacker according to claim 3, wherein, along with a change of the angle of the sheet stacking member from the first angle to the second angle, a contact portion of one member of the upper limit regulation member and the upper limit regulation target member is configured to contact a contact target portion of another member of the upper limit regulation member and the upper limit regulation target member, wherein, after the upper limit regulation member and the upper limit regulation target member relatively move by a contact force, the contact portion of the one member is configured to engage with the contact target portion of said another member to switch the regulator from the non-regulating state to the regulating state.

11. The sheet stacker according to claim 10, wherein, when the angle of the sheet stacking member is changed from the first angle to the second angle, the contact portion of the one member is configured to slide along a contact target face of the contact target portion of said another member by the contact force, wherein, after the upper limit regulation target member and the upper limit regulation member relatively move and the contact portion reaches an end portion of the contact target portion, the contact portion of the one member is configured to disengage from the contact target portion of said another member to switch the regulator from the non-regulating state to the regulating state.

12. The sheet stacker according to claim 3, further comprising another regulator configured to:

enter the regulating state when the sheet stacking member is at the first angle; and enter the non-regulating state when the sheet stacking member is at the second angle.

13. The sheet stacker according to claim 12, wherein the regulator is configured to regulate the upstream portion in the sheet conveyance direction of the sheet stacking member at the first angle to be an equal upper height limit position to the upper height limit position of the upstream portion in the sheet conveyance direction of the sheet stacking member at the second angle.

14. An image forming apparatus comprising:

an image bearer configured to form an image on a sheet; and the sheet stacker according to claim 1, configured to stack the sheet having the image.

15. A sheet stacker comprising:

a sheet stacking tray having an upstream portion in a sheet conveyance direction, the upstream portion being movable in a vertical direction;

a height adjuster spring configured to apply a biasing force to bias the sheet stacking tray upward, an end of the height adjuster spring being coupled to the sheet stacking tray;

a slider configured to set an angle of the sheet stacking member in the sheet conveyance direction, relative to a sheet conveying portion, between a first angle and a second angle, the slider including a contact target face configured to contact a contact face of the sheet stacking tray; and a regulator configured to regulate movement of the sheet stacking member in a case in which the upstream portion of the sheet stacking member is located closer to the sheet conveying portion at either the first angle or the second angle, the regulator including an upper limit regulator hook, and a tray side hook mounted on the sheet stacking tray and configured to engage with the upper limit regulator hook.

16. The sheet stacker according to claim 15, wherein the regulator is configured to:

enter a regulating state in which the regulator regulates an upper height limit position of the upstream portion of the sheet stacking tray, as the upper limit regulator hook contacts the tray side hook when the sheet stacking tray is at the second angle; and switch from the regulating state to a non-regulating state in which the regulator does not regulate the upper height limit position of the upstream portion of the sheet stacking member, as the upper limit regulator hook and the tray side hook relatively move in a direction intersecting a contact direction in which the upper limit regulator hook contacts the tray side hook, along with angle setting movement of the slider, when the sheet stacking tray is changed from the second angle to the first angle.

17. The sheet stacker according to claim 16, wherein the upper limit regulator hook and the tray side hook are configured to move relatively in response to movement of one hook of the upper limit regulator hook or the tray side hook, and the other hook of the upper limit regulator hook or the tray side hook is configured to be biased in a biasing direction opposite to a direction in which the one hook moves.

18. The sheet stacker according to claim 17, wherein the upper limit regulator hook includes a contact portion configured to regulate movement of the other hook.

19. The sheet stacker according to claim 16, wherein the sheet stacking tray includes an upstream guide projection configured to:

enter the regulating state when the sheet stacking tray is at the first angle; and enter the non-regulating state when the sheet stacking tray is at the second angle.

20. A sheet stacker comprising:

a sheet stacking tray having an upstream portion in a sheet conveyance direction, the upstream portion being movable in a vertical direction;

a height adjuster spring configured to apply a biasing force to bias the sheet stacking tray upward;

a slider configured to set an angle of the sheet stacking member in the sheet conveyance direction, relative to a sheet conveying portion, between a first angle and a second angle; and a regulator configured to regulate movement of the sheet stacking member in a case in which the upstream portion of the sheet stacking member is located closer to the sheet conveying portion at either the first angle or the second angle.

* * * * *